US006961035B2

(12) United States Patent
Endo et al.

(10) Patent No.: US 6,961,035 B2
(45) Date of Patent: Nov. 1, 2005

(54) LIQUID CRYSTAL PROJECTOR APPARATUS AND DRIVING METHOD FOR LIQUID CRYSTAL PROJECTOR APPARATUS

(75) Inventors: Hiroaki Endo, Kanagawa (JP); Yoshiki Shirochi, Chiba (JP); Shigeki Ohno, Kanagawa (JP)

(73) Assignee: Sony Corporation, Tokyo (JP)

( * ) Notice: Subject to any disclaimer, the term of this patent is extended or adjusted under 35 U.S.C. 154(b) by 260 days.

(21) Appl. No.: 10/074,414

(22) Filed: Feb. 12, 2002

(65) Prior Publication Data

US 2002/0158825 A1 Oct. 31, 2002

(30) Foreign Application Priority Data

Feb. 14, 2001 (JP) ..... 2001-037249

(51) Int. Cl.[7] ..... G09G 3/36

(52) U.S. Cl. ..... 345/87; 345/97; 345/98; 345/100

(58) Field of Search ..... 345/76, 80, 87, 345/97, 98, 100, 204–206, 156, 158, 184, 1.3; 349/106; 348/748; 353/101

(56) References Cited

U.S. PATENT DOCUMENTS 5,537,168 A * 7/1996 Kitagishi et al. ..... 353/101
5,613,103 A * 3/1997 Nobutani et al. ..... 345/556
5,754,154 A * 5/1998 Katakura et al. ..... 345/97
5,774,105 A * 6/1998 Yamamoto et al. ..... 345/97
RE36,060 E * 1/1999 Miyashita ..... 348/748
6,160,540 A * 12/2000 Fishkin et al. ..... 345/184
6,163,352 A * 12/2000 Ichikawa et al. ..... 349/106
6,163,360 A * 12/2000 Tanaka et al. ..... 349/172
6,243,075 B1 * 6/2001 Fishkin et al. ..... 345/156
6,297,805 B1 * 10/2001 Adler et al. ..... 345/158
6,340,957 B1 * 1/2002 Adler et al. ..... 345/1.3
6,467,911 B1 * 10/2002 Ueyama et al. ..... 353/87
6,628,258 B1 * 9/2003 Nakamura ..... 345/98
6,628,355 B1 * 9/2003 Takahara ..... 349/106
6,630,922 B2 * 10/2003 Fishkin et al. ..... 345/156

* cited by examiner

*Primary Examiner*—Vijay Shankar
*Assistant Examiner*—Prabodh Dharia
(74) *Attorney, Agent, or Firm*—Frommer Lawrence & Haug LLP; William S. Frommer; Thomas F. Presson

(57) ABSTRACT

A liquid crystal projector apparatus is presented, which can display an image free from an influence of a temperature variation of a liquid crystal panel without the necessity to directly measure the temperature of the liquid crystal panel. The liquid crystal projector apparatus includes a temperature sensor for detecting a temperature at a location in the liquid crystal projector apparatus except liquid crystal panels, a memory for storing temperature detection data obtained by the temperature sensor within a period from a power supply starting time to a steady operation entering time, an arithmetic operation device for estimating a temperature of each of the liquid crystal panels based on the temperature detection data stored in the memory, and liquid crystal drive sections for correcting drive voltages for driving the liquid crystal panels with output signals of the arithmetic operation device.

10 Claims, 18 Drawing Sheets

DATA OF STARTING TIME SHIFT TEMPERATURE (TS) (FOR RED)

DATA OF STARTING TIME SHIFT TEMPERATURE (TS) (FOR GREEN)

DATA OF STARTING TIME SHIFT TEMPERATURE (TS) (FOR BLUE)

LIQUID CRYSTAL PROJECTOR APPARATUS AND DRIVING METHOD FOR LIQUID CRYSTAL PROJECTOR APPARATUS

BACKGROUND OF THE INVENTION

This invention relates to a liquid crystal projector apparatus which includes a liquid crystal display panel for optically modulating light from a light source with an input signal and projects the optically modulated light from the liquid crystal panel to display an image and a driving method for a liquid crystal projector apparatus.

As an example of an image display apparatus, a liquid crystal projector apparatus which makes use of a liquid crystal panel is known. Such liquid crystal projector apparatus include an apparatus called rear projector.

A liquid crystal projector apparatus of the type mentioned uses three liquid crystal panels (also called liquid crystal light valves) for optically modulating the colors of, for example, red, green and blue to combine light of the three components and projects the combined color onto a screen through a lens to display a color image in an enlarged scale. A liquid crystal projector apparatus of the type described includes a lamp as a light source for projecting a video (image) to display it. The lamp generates a great amount of heat and requires cooling thereof.

By the way, liquid crystal panels used in a liquid crystal projector apparatus have such a so-called V-T characteristic (drive voltage-transmissivity) as illustrated in FIG. 18. The axis of ordinate of the V-T characteristic indicates the transmissivity of a liquid crystal panel, and the axis of abscissa indicates the driving voltage (applied voltage) applied to the liquid crystal panel. The V-T characteristic has a characteristic that it is shifted in the direction of the axis of abscissa in response to a variation of the temperature.

The V-T characteristic has a characteristic that, if the temperature rises, for example, from 26.5° C. to 48.6° C. and the V-T characteristic is shifted, then in a gradation portion of the driving voltage of 2.5 V, a drop of the transmissivity of approximately 20%, that is, a drop of the luminance, occurs. Such a variation of the luminance by a temperature variation as just described exhibits its maximum with an intermediate gradation.

Such a drop of the transmissivity of a liquid crystal panel, that is, a drop of the luminance of a liquid crystal panel, as described above is caused by such a shift of the V-T characteristic as shown in FIG. 18 by the temperature of the liquid crystal panel. Therefore, the variation of the luminance of the liquid crystal is not uniform among different gradations. In other words, if a drive signal portion is corrected with a gain or an offset as in correction of the brightness in an ordinary television receiver or the like, then the gradation property of the liquid crystal panel is disordered.

Therefore, for the correction against a temperature variation of a liquid crystal panel, not correction of the brightness but correction of the shift of the V-T characteristic diagram must be performed, and it is known by Japanese Patent No. 2924073 that a shift of a drive voltage (applied voltage) to a liquid crystal panel, that is, a shift of the V-T characteristic, with regard to the axis of abscissa is required.

By the way, where a liquid crystal projector apparatus is used, upon starting of a power supply, the temperature of the liquid crystal panels corresponds to a room temperature. However, after starting of the power supply, since the liquid crystal panels are heated by a light source such as a lamp, the temperature of the liquid crystal panels rises up to approximately 50° C.

The liquid crystal panels are disposed in a housing of the liquid crystal projector apparatus, and the liquid crystal panels are cooled by a cooling fan in the housing. In a liquid crystal projector apparatus of the structure that the liquid crystal panels are cooled by a flow of wind by a cooling fan in this manner, the air in the housing is circulated to cool the liquid crystal panels without taking in external air. The reason why the liquid crystal panels are cooled by air circulation in the housing without taking in external air in this manner is that it is intended to augment the dust-proof performance. In a liquid crystal projector apparatus of such a structure as just described, a fixed time requires until the temperature of the liquid crystal panels rises.

In order to directly measure the temperature of a liquid crystal panel, it is necessary to provide a temperature sensor in a closely contacting relationship with the liquid crystal panel positioned in the dust-proof housing. However, to provide a temperature sensor in a closely contacting relationship with a liquid crystal panel in this manner is difficult due to the following reason in terms of the structure.

As the reason, there is a problem that the temperature sensor cannot be provided at a position at which light of the liquid crystal panel passes, that the area of a portion of each liquid crystal panel at which the temperature sensor is provided is limited because the liquid crystal panels are small in size, that, where the temperature sensor is built in the liquid crystal sensor, an increased cost is required, or the like.

Therefore, it is a possible idea to dispose the temperature sensor at a location in the housing other than the liquid crystal panels, for example, on a circuit board in the housing. Where the temperature sensor is disposed on the circuit board in this manner, a difference appears between temperature rise curves of the actual temperature of the liquid crystal panel and the temperature detected by the temperature sensor on the circuit board.

Where it is intended to indirectly measure the temperature of the liquid crystal panel by means of the temperature sensor provided on the circuit board, since a difference appears between the temperature in the apparatus and the actual temperature of the liquid crystal panel, even if it is tried to measure the actual temperature of the liquid crystal panel, an error occurs. Accordingly, if, when a power supply for the liquid projector apparatus is started, it is tried to indirectly measure the temperature of the liquid crystal panel by means of the temperature sensor on the circuit board and correct the value of the driving voltage to be applied to the liquid crystal panel, then an error occurs.

Usually, in an environment wherein a television receiver in which a Braun tube or the like is used is watched, the room temperature variation during use of the television receiver is, where the room temperature is 25° C., approximately ±10° C. with respect to the temperature of 25° C. However, when a liquid crystal projector apparatus is used, where the room temperature is 25° C., the temperature variation of the liquid crystal panel upon starting of the power supply is a rise of more than 25° C. with respect to 25° C. (50° C.−25° C.=25° C.). If the time of the temperature variation of the liquid crystal panel when the power supply is started is shorter than the time in which the luminance of the light source in the form of a lamp is stabilized, then the temperature of the liquid crystal panel rises in a moment. Accordingly, no particular problem occurs because the user can adjust the picture quality to a stable optimum picture quality while the user does not become aware that the temperature variation of the liquid crystal panel when the power supply is started has an influence on the projected picture quality.

In the liquid crystal projector apparatus, however, since the liquid crystal panels are cooled by circulated air in the housing as described above, the rate of the temperature rise of the liquid crystal panels upon starting of the power supply is lowered by such cooling by the cooling fan when compared with that in an alternative case wherein the liquid crystal panel is not cooled. Consequently, since the rise of the temperature variation of the liquid crystal panel when the power supply is started is slow, a drop of the luminance of the liquid crystal panel occurs, and this gives rise to a problem of at what point of time the picture quality should be adjusted to an optimum picture quality. Since particularly a liquid crystal panel for a liquid crystal projector apparatus wherein air is circulated in the housing as a countermeasure for dust-proof as described above requires a longer period of time until the temperature of the liquid crystal panel rises upon starting of the power supply, a longer period of time is required until the temperature of the liquid crystal panel upon steady operation is stabilized after starting of the power supply, and a variation of the picture quality by a temperature variation of the liquid crystal panel when the power supply is started becomes liable to be visually recognized by the user.

SUMMARY OF THE INVENTION

It is an object of the present invention to provide a liquid crystal projector apparatus and a driving method for a liquid crystal projector apparatus which eliminate the subjects described above and can display an image with an optimum picture quality free from an influence of a temperature variation of a liquid crystal panel without the necessity to directly measure the temperature of the liquid crystal panel.

The invention of claim 1 is a liquid crystal projector apparatus which includes a liquid crystal panel for optically modulating light from a light source with an input signal and projects the optically modulated light from the liquid crystal panel to display an image, characterized in that it includes a temperature sensor for detecting a temperature at a location in the liquid crystal projector apparatus except the liquid crystal panel, a memory for storing temperature detection data obtained by the temperature sensor within a period from a power supply starting time to a steady operation entering time of the liquid crystal projector apparatus, arithmetic operation means for estimating a temperature of the liquid crystal panel based on the temperature detection data stored in the memory to indirectly obtain the temperature of the liquid crystal panel, and a liquid crystal drive section for correcting a drive voltage for driving the liquid crystal panel with an output signal of the arithmetic operation means and applying the corrected drive voltage to the liquid crystal panel.

In claim 1, the temperature sensor detects a temperature at a location in the liquid crystal projector apparatus except the liquid crystal panel.

The memory stores temperature detection data obtained by the temperature sensor within a period from a power supply starting time to a steady operation entering time of the liquid crystal projector apparatus.

The arithmetic operation means estimates a temperature of the liquid crystal panel based on the temperature detection data stored in the memory to indirectly obtain the temperature of the liquid crystal panel.

The liquid crystal drive section corrects a drive voltage for driving the liquid crystal panel with an output signal of the arithmetic operation means and applies the corrected drive voltage to the liquid crystal panel.

Consequently, although the actual temperature of the liquid crystal panel is not measured directly by means of the temperature sensor, the temperature of the liquid crystal panel is estimated based on the temperature detection data obtained by the temperature sensor to indirectly obtain the temperature of the liquid crystal panel. And, the liquid crystal drive section corrects the drive voltage to be applied to the liquid crystal panel corresponding to the temperature of the liquid crystal panel with the output signal of the arithmetic operation means. Consequently, even if a long period of time is required for a rise of the temperature of the liquid crystal within the period of time after the power supply starting time till the steady operation entering time of the liquid crystal panel, the temperature variation of the liquid crystal panel does not have an influence on the picture quality, and an image can be displayed with an optimum picture quality.

According to the invention of claim 2, the liquid crystal projector apparatus according to claim 1 is configured such that the liquid crystal drive section controls a dc component of the drive voltage to be applied to the liquid crystal panel to correct the voltage.

According to the invention of claim 3, the liquid crystal projector apparatus according to claim 2 is configured such that the light source and the liquid crystal panel are disposed in a housing, and the liquid crystal projector apparatus further includes cooling means for circulating air in the housing without taking in external air to cool the liquid crystal panel in the housing.

In claim 3 , where air is circulated in the housing without taking in external air to cool the liquid crystal panel in the housing, even if a long period of time is required for a rise of the temperature of the liquid crystal panel, an image can be displayed with an optimum picture quality.

According to the invention of claim 4, the liquid crystal projector apparatus according to claim 3 is configured such that the liquid crystal panel includes a liquid crystal panel for red, a liquid crystal panel for green and a liquid crystal panel for blue, and the liquid crystal drive section includes a first liquid crystal drive section for correcting a drive voltage for driving the liquid crystal panel for red with an output signal of the arithmetic operation means and applying the corrected drive voltage to the liquid crystal panel for red, a second liquid crystal drive section for correcting a drive voltage for driving the liquid crystal panel for green with another output signal of the arithmetic operation means and applying the corrected drive voltage to the liquid crystal panel for green, and a third liquid crystal drive section for correcting a drive voltage for driving the liquid crystal panel for blue with a further output signal of the arithmetic operation means and applying the corrected drive voltage to the liquid crystal panel for blue.

In claim 4, the liquid crystal panel for red, liquid crystal panel for green and liquid crystal panel for blue can be used to display a color image of an optimum picture quality.

According to the invention of claim 5, the liquid crystal projector apparatus according to claim 1 is configured such that it further includes a room temperature detection sensor for detecting a room temperature separately from the temperature sensor, and the arithmetic operation means arithmetically operates, at the power supply starting time, a difference between the temperature detection data of the temperature sensor and room temperature detection data of the room temperature detection sensor.

In claim 5, the room temperature detection sensor for detecting a room temperature is provided separately from the temperature sensor, and the arithmetic operation means arithmetically operates, at the power supply starting time, a difference between the temperature detection data of the temperature sensor and room temperature detection data of the room temperature detection sensor. Consequently, at the power supply starting time, it can be discriminated whether the power supply starting is the first time starting or re-starting is performed after the starting is stopped after power supply starting.

Consequently, since the temperature of the liquid crystal panel exhibits a rise, an error occurs with the estimated value of the temperature of the liquid crystal panel within the period of time after the power supply starting time till the steady operation entering time, and consequently, the temperature of the liquid crystal panel can be estimated more accurately by discriminating whether or not re-starting is performed and an image can be displayed with a more optimum picture quality.

The invention of claim 6 is a driving method for a liquid crystal projector apparatus which includes a liquid crystal panel for optically modulating light from a light source with an input signal and projects the optically modulated light from the liquid crystal panel to display an image, characterized in that it includes a temperature detection step of detecting a temperature at a location in the liquid crystal projector apparatus except the liquid crystal panel by means of a temperature detector, an arithmetic operation step of storing temperature detection data obtained by the temperature sensor within a period from a power supply starting time to a steady operation entering time of the liquid crystal projector apparatus into a memory and estimating a temperature of the liquid crystal panel based on the temperature detection data stored in the memory to indirectly obtain the temperature of the liquid crystal panel by means of arithmetic operation means, and a drive voltage supplying step of correcting a drive voltage for driving the liquid crystal panel with an output signal of the arithmetic operation means and applying the corrected drive voltage to the liquid crystal panel.

In claim 6, the temperature detection step detects a temperature at a location in the liquid crystal projector apparatus except the liquid crystal panel by means of a temperature detector.

The arithmetic operation step stores temperature detection data obtained by the temperature sensor within a period from a power supply starting time to a steady operation entering time of the liquid crystal projector apparatus into a memory and estimates a temperature of the liquid crystal panel based on the temperature detection data stored in the memory to indirectly obtain the temperature of the liquid crystal panel by means of arithmetic operation means.

The drive voltage supplying step corrects a drive voltage for driving the liquid crystal panel with an output signal of the arithmetic operation means and applies the corrected drive voltage to the liquid crystal panel.

Consequently, although the actual temperature of the liquid crystal panel is not measured directly by means of the temperature sensor, the temperature of the liquid crystal panel is estimated based on the temperature detection data obtained by the temperature sensor to indirectly obtain the temperature of the liquid crystal panel. And, the liquid crystal drive section corrects the drive voltage to be applied to the liquid crystal panel corresponding to the temperature of the liquid crystal panel with the output signal of the arithmetic operation means. Consequently, even if a long period of time is required for a rise of the temperature of the liquid crystal within the period of time after the power supply starting time till the steady operation entering time of the liquid crystal panel, the temperature variation of the liquid crystal panel does not have an influence on the picture quality, and an image can be displayed with an optimum picture quality.

According to the invention of claim 7, the driving method for a liquid crystal projector apparatus according to claim 6 is configured such that the liquid crystal drive section controls a dc component of the drive voltage to be applied to the liquid crystal panel to correct the voltage.

According to the invention of claim 8, the driving method for a liquid crystal projector apparatus according to claim 7, wherein the light source and the liquid crystal panel are disposed in a housing, and cooling means circulates air in the housing without taking in external air to cool the liquid crystal panel in the housing.

In claim 8, where air is circulated in the housing without taking in external air to cool the liquid crystal panel in the housing, even if a long period of time is required for a rise of the temperature of the liquid crystal panel, an image can be displayed with an optimum picture quality.

According to the invention of claim 9, the driving method for a liquid crystal projector apparatus according to claim 8 is configured such that the liquid crystal panel includes a liquid crystal panel for red, a liquid crystal panel for green and a liquid crystal panel for blue, and a first liquid crystal drive section corrects a drive voltage for driving the liquid crystal panel for red with an output signal of the arithmetic operation means and applies the corrected drive voltage to the liquid crystal panel for red, a second liquid crystal drive section corrects a drive voltage for driving the liquid crystal panel for green with another output signal of the arithmetic operation means and applies the corrected drive voltage to the liquid crystal panel for green, and a third liquid crystal drive section corrects a drive voltage for driving the liquid crystal panel for blue with a further output signal of the arithmetic operation means and applies the corrected drive voltage to the liquid crystal panel for blue.

In claim 9, the liquid crystal panel for red, liquid crystal panel for green and liquid crystal panel for blue can be used to display a color image of an optimum picture quality.

According to the invention of claim 10, the driving method for a liquid crystal projector apparatus according to claim 6 is configured such that the liquid crystal projector apparatus further includes a room temperature detection sensor for detecting a room temperature separately from the temperature sensor, and the arithmetic operation means arithmetically operates, at the power supply starting time, a difference between the temperature detection data of the temperature sensor and room temperature detection data of the room temperature detection sensor.

In claim 10, the room temperature detection sensor for detecting a room temperature is provided separately from the temperature sensor, and the arithmetic operation means arithmetically operates, at the power supply starting time, a difference between the temperature detection data of the temperature sensor and room temperature detection data of the room temperature detection sensor. Consequently, at the power supply starting time, it can be discriminated whether the power supply starting is the first time starting or re-starting is performed after the starting is stopped after power supply starting.

Consequently, since the temperature of the liquid crystal panel exhibits a rise, an error occurs with the estimated value of the temperature of the liquid crystal panel within the period of time after the power supply starting time till the steady operation entering time, and consequently, the temperature of the liquid crystal panel can be estimated more accurately by discriminating whether or not re-starting is performed and an image can be displayed with a more optimum picture quality.

As described above, according to the present invention, an image can be displayed with an optimum picture quality free from an influence of a temperature variation without the necessity to directly measure the temperature of a liquid crystal panel.

DETAILED DESCRIPTION OF THE PREFERRED EMBODIMENTS

In the following, preferred embodiments of the present invention are described in detail with reference to the accompanying drawings.

It is to be noted that, since the embodiments described below are preferred particular examples of the present invention, various technically preferable limitations are applied to the embodiments, but the scope of the present invention is not limited to the embodiments unless it is recited in the following description that the present invention should be limited.

Figure 1:
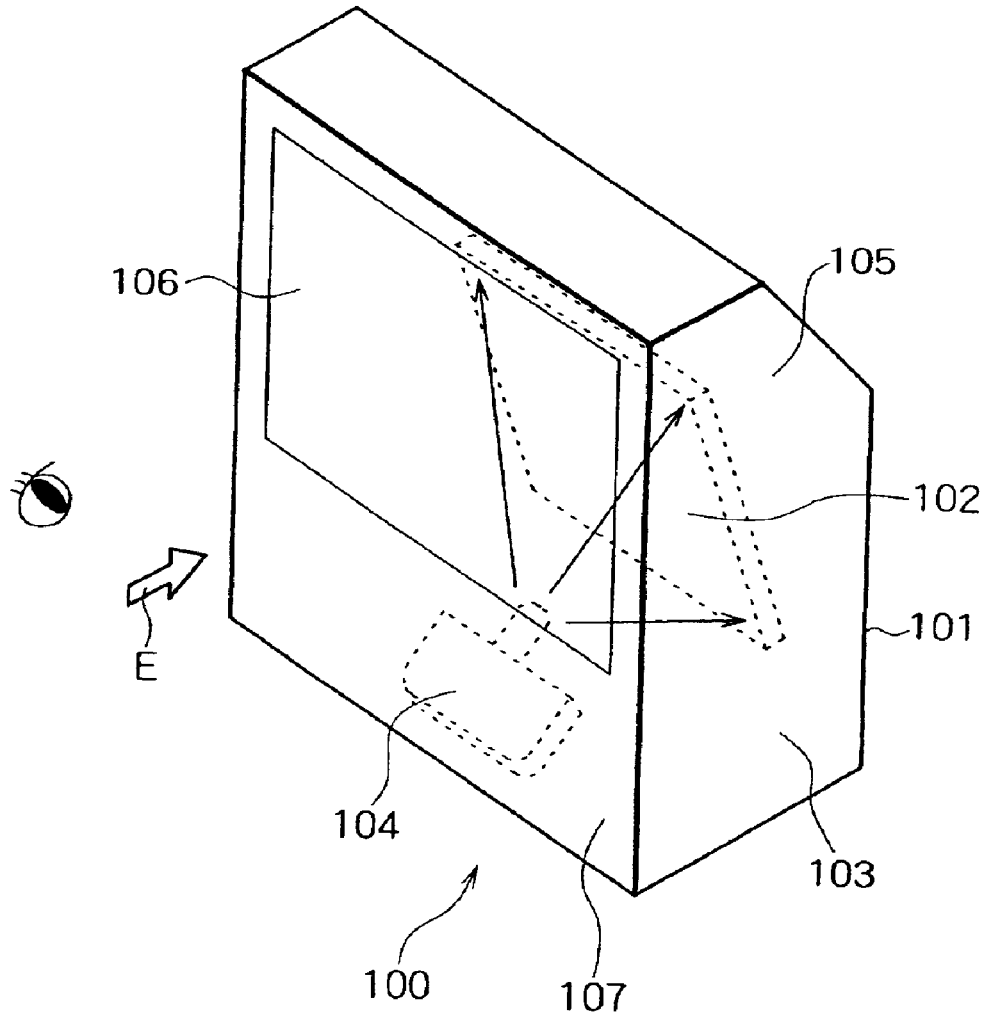
FIG. 1 is a perspective view of a preferred embodiment of a liquid crystal projector apparatus of the present invention.

FIG. 1 is a perspective view showing an appearance of a preferred embodiment of a liquid crystal projector apparatus of the present invention.

Referring to FIG. 1, a liquid crystal projector apparatus 100 is called rear projector and has a housing 101. A mirror 102, an optical unit 104 and so forth are built in the housing 101.

The housing 101 has an upper portion 105 and a lower portion 103, and a screen 106 is provided on the front side of the upper portion 105. A color image projected by the optical unit 104 is reflected by the mirror 102 and can be projected in an enlarged scale to the rear face side (inner face side) of the screen 106 of a front face portion 107. The liquid crystal projector apparatus 100 is a color liquid crystal projector apparatus of the so-called three-plate type which uses three liquid crystal panels.

Figure 2:
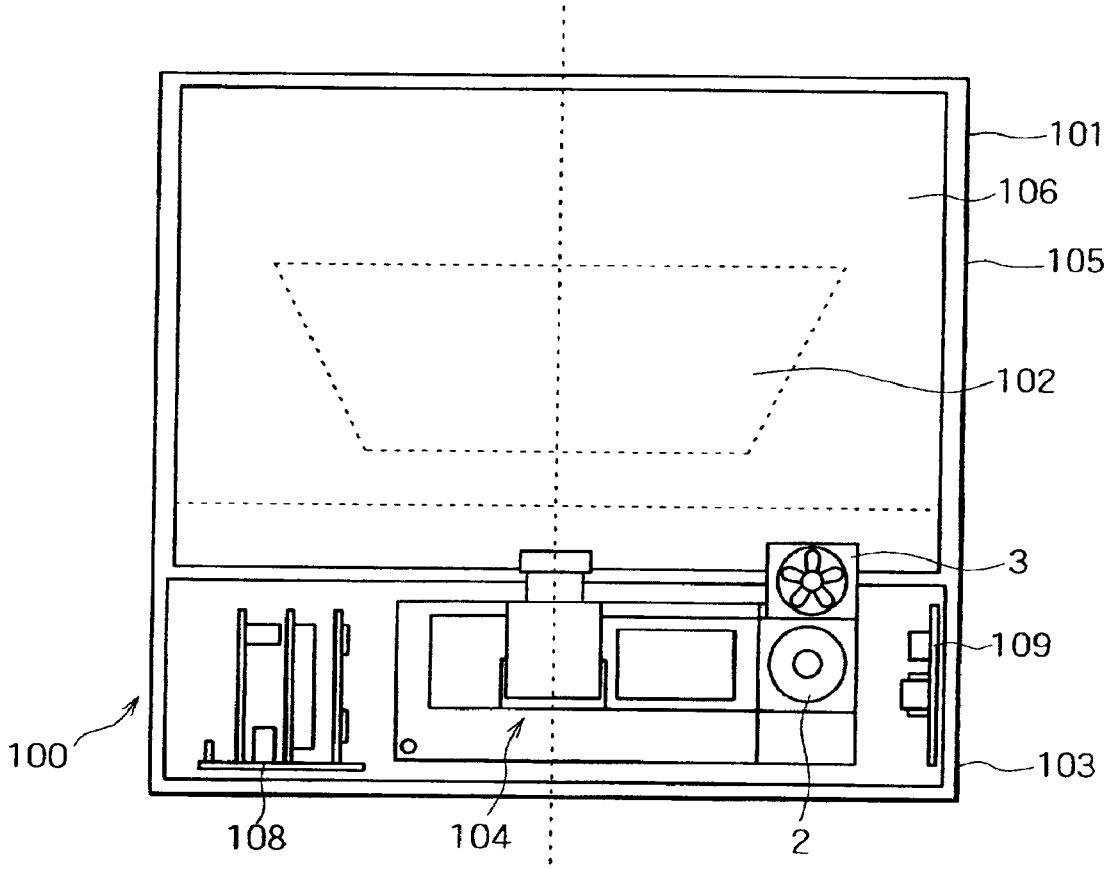
FIG. 2 is a front view showing an example of the liquid crystal projector apparatus of FIG. 1.

FIG. 2 shows an example of an internal structure of the liquid crystal projector apparatus 100 when the liquid crystal projector apparatus 100 of FIG. 1 is viewed from the E side.

The upper portion 105 of the housing 101 has the screen 106. A pair of circuit boards 108 and 109, the optical unit 104 and so forth are built in the lower portion 103. The optical unit 104 is positioned substantially center of the lower portion 103, and the circuit boards 108 and 109 are disposed on the right side and the left side of the optical unit 104. A fan 3 for cooling a light source and so forth is provided in the proximity of a light source 2 such as a lamp of the optical unit 104. The cooling fan 3 is rotated to radiate heat generated by the light source 2 to the outside.

Figure 3:
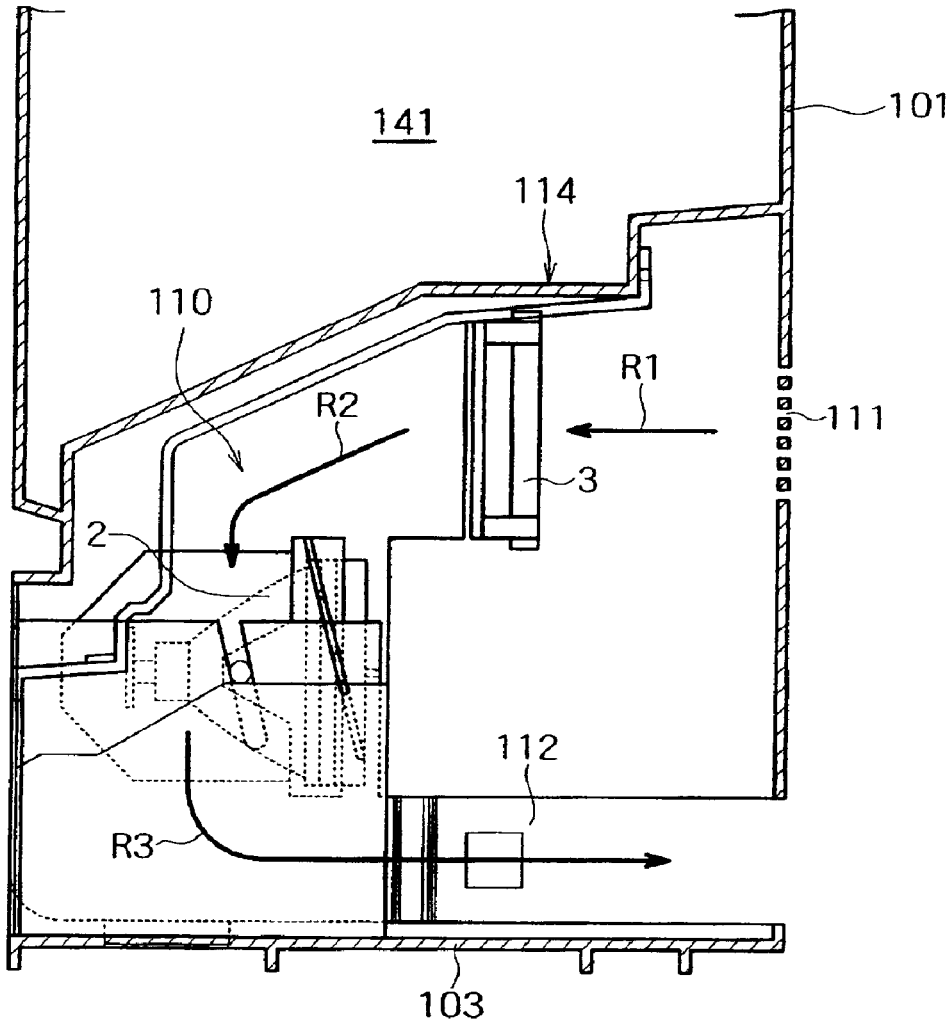
FIG. 3 is a view showing an example of a structure of a cooling system for a light source of the liquid crystal projector apparatus of FIG. 1.

FIG. 3 illustrates a manner wherein the fan 3 cools the light source 2.

When the fan 3 rotates, external air is introduced in a direction R1 into the housing 101 through an opening 111 of the housing 101, and the air is guided in a direction of R2 along a guide duct 110 to cool the light source 2. The air after the cooling is discharged along a direction R3 to the outside of the housing 101 through a duct 112.

In this manner, the cooling path for the light source 2 shown in FIG. 3 is a region sectioned by a wall 114 so as to be separate from the other space 141 of the housing 101.

Figure 4:
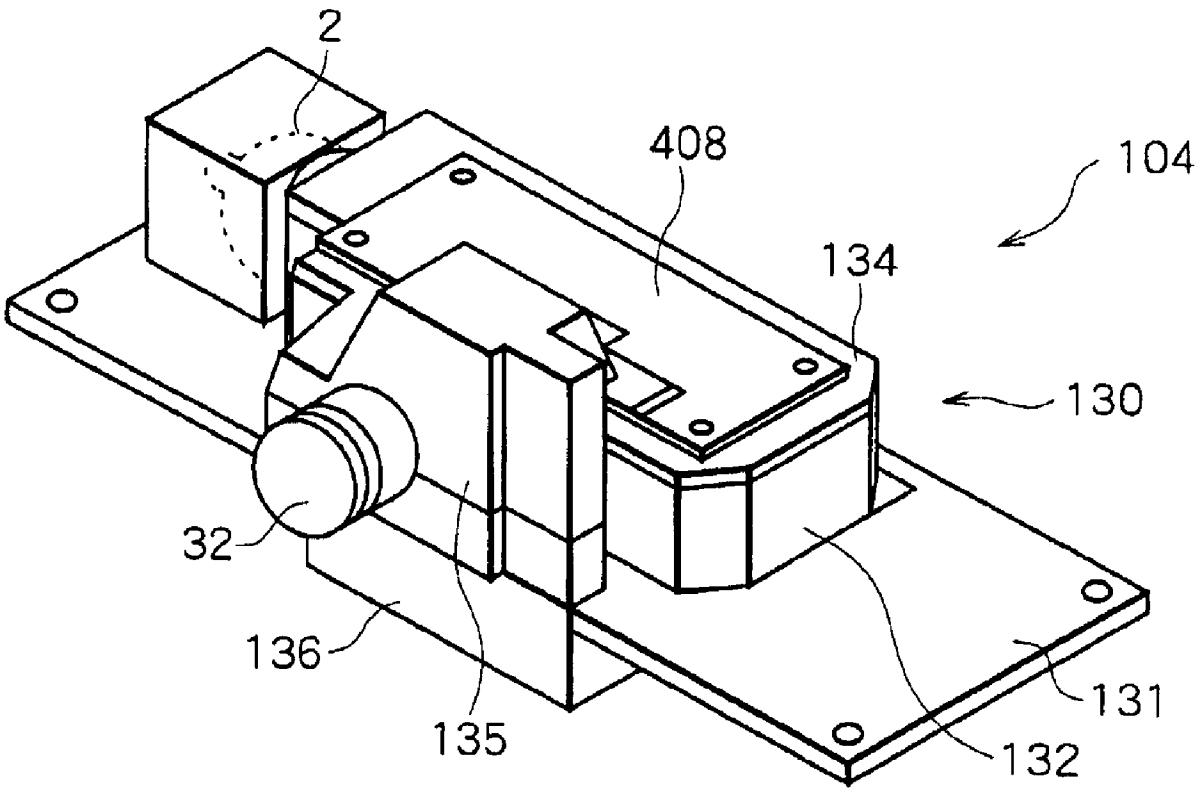
FIG. 4 is a perspective view showing an example of a structure of an optical unit of the liquid crystal projector apparatus.

FIG. 4 shows the optical unit 104 provided in the liquid crystal projector apparatus 100 of FIG. 1.

The light source 2 and an optical block 130 are disposed on a base plate 131 provided in a housing of the optical unit 104. The optical block 130 includes an optical block case 132, a lid 134 for closing the top of the optical block case 132, an upper cover 135, a lower cover 136, and a circuit board 408. Optical parts are accommodated in the optical block 130 as shown in FIG. 5.

Figure 5:
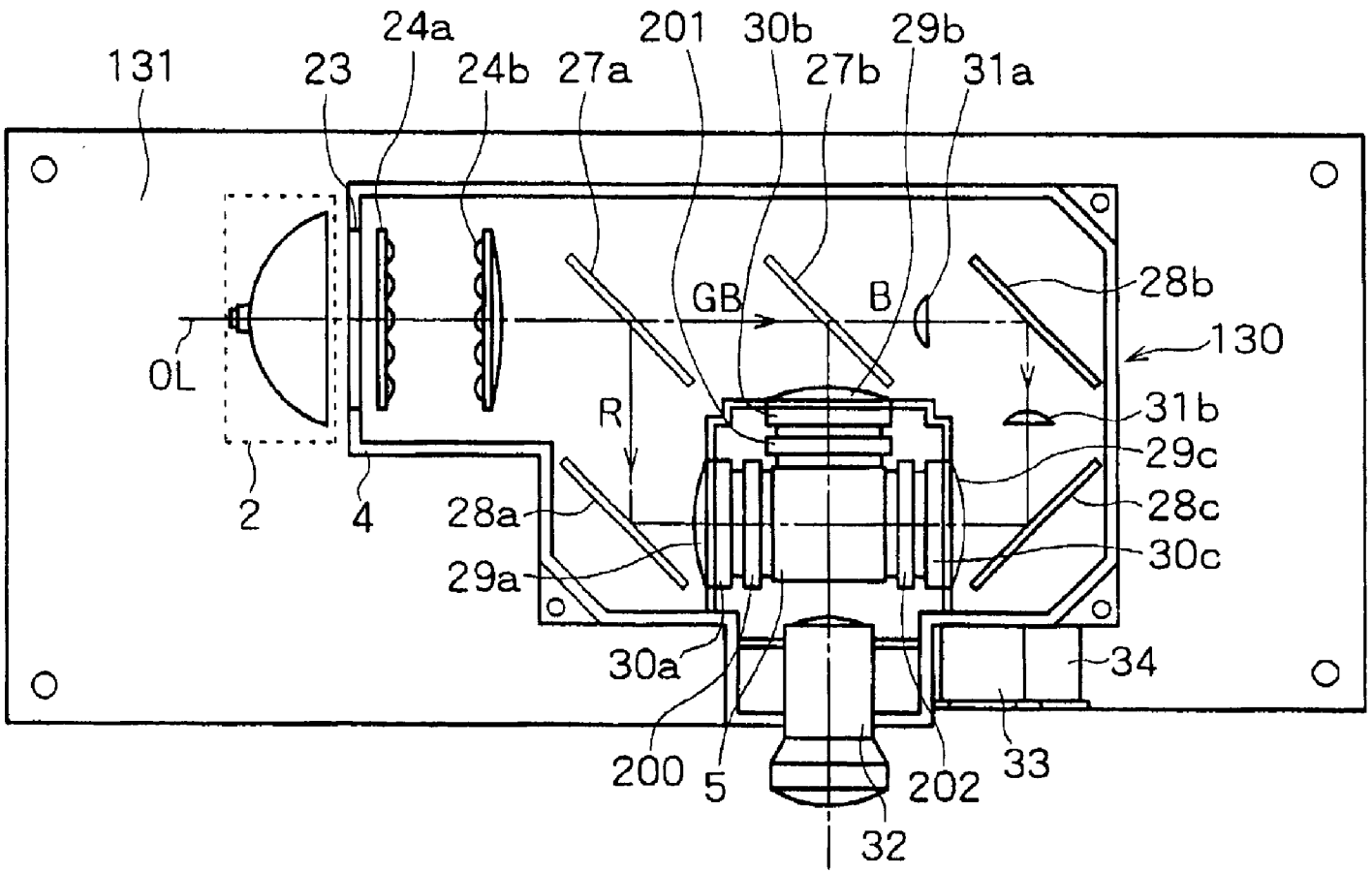
FIG. 5 is a view showing an example of an internal structure of the optical unit.

The optical block 130 includes, for example, such optical parts as shown in FIG. 5. A pair of lens arrays 24*a* and 24*b* are disposed adjacent the light source 2, and a pair of dichroic mirrors 27*a* and 27*b* and reflecting mirrors 28*a*, 28*b* and 28*c* for separating light from the light source 2 into lights of red, green and blue are disposed along an OL.

The dichroic mirrors 27*a* and 27*b* and the reflecting mirrors 28*a*, 28*b* and 28*c* serve as separating optical means of light of the light source 2. Along paths along which the separated lights of the three colors pass, condensers 29*a*, 29*b* and 29*c*, polarizing plates 30*a*, 30*b* and 30*c*, and liquid crystal panels 200, 201 and 202 which serve as optical modulation means are disposed such that the lights of the three colors may be introduced separately into different faces of a combining prism 5 serving as combining optical means. A projection lens 32 for projecting the combined light in an enlarged scale is provided in the following stage of the combining prism 5.

Here, operation of the optical block 130 is described.

Illuminating light from the light source 2 such as a metal halide lamp passes through a cut filter 23 which intercepts ultraviolet rays and infrared rays, and enters the optical block 130.

The illuminating light entering the optical block 130 passes through the lens arrays 24*a* and 24*b*, and red light R of the illuminating light is separated and reflected by the dichroic mirror 27*a*. The separated red light R is reflected by the reflecting mirror 28*a*, passes through the condenser 29*a* and the polarizing plate 30*a*, and then passes through the liquid crystal panel 200 for red.

The illuminating light having passed through the dichroic mirrors 27*a*, that is, green light G and blue light B, the green light G is separated and reflected by the dichroic mirror 27*b*. The separated green light G passes through the condenser 29*b* and the polarizing plates 30*b* and then passes through the liquid crystal panel 201 for green.

The blue light B having passed through the dichroic mirror 27*b* passes through a lens 31*a*, is reflected by the reflecting mirror 28*b*, and then passes through another lens 31*b* and is reflected by the reflecting mirror 28*c*, whereafter it passes through the condenser 29*c* and the polarizing plate 30*c* and then passes through the liquid crystal panel 202 for blue.

The liquid crystal panels 200, 201 and 202 are driven by drive circuits based on video input signals of red, green and blue and optically modulate the red light, green light and blue right, respectively. Thereafter, the lights having passed through the liquid crystal panels 200, 201 and 202 for the three colors are combined by the combining prism 5 and projected in color in an enlarged scale on the screen 106 of FIG. 1 by the projection lens 32. A color image is displayed on the screen by the optical block 130 in this manner.

Figure 6:
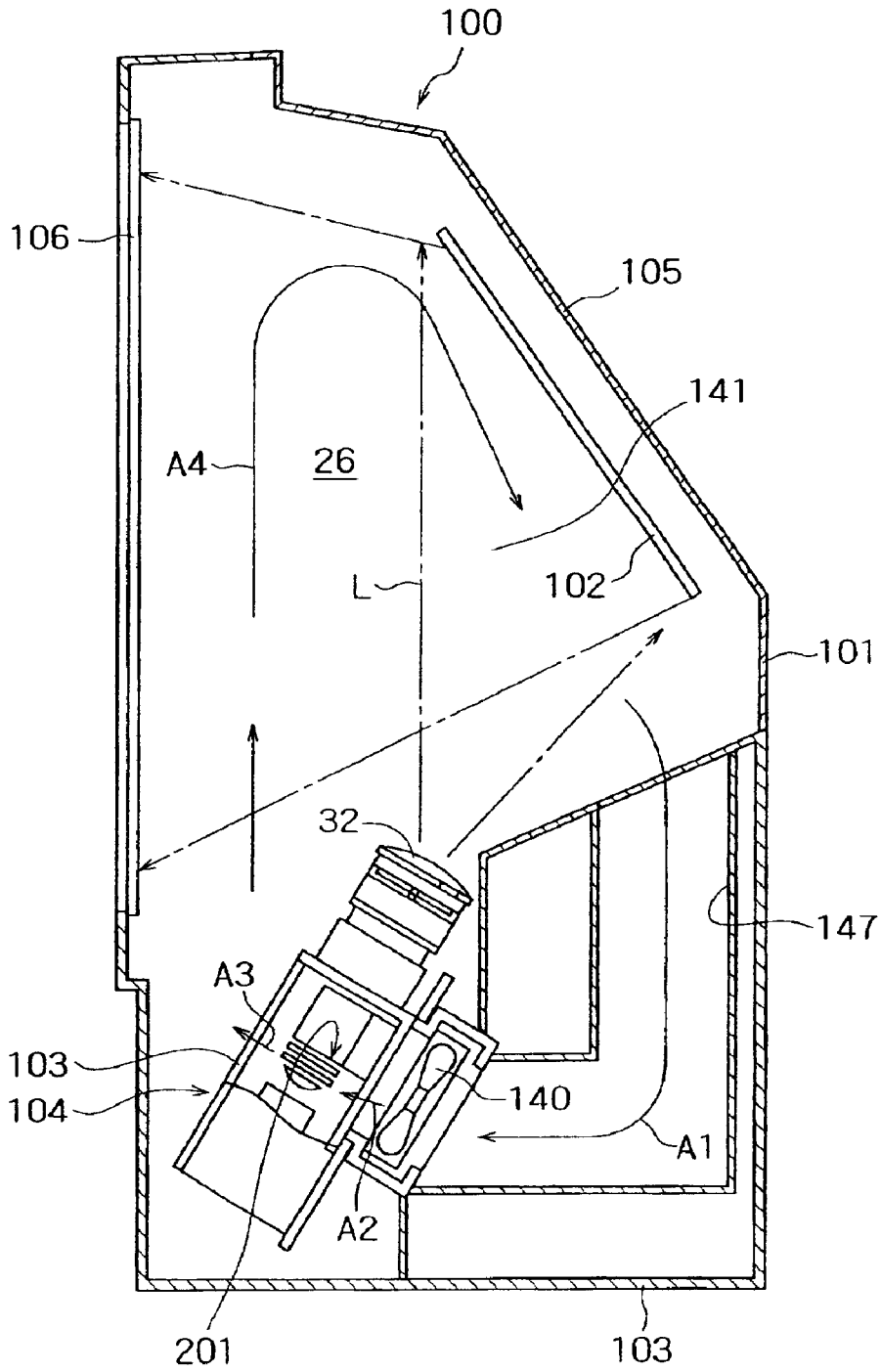
FIG. 6 is a view illustrating an example of circulation of air for cooling a liquid crystal panel in a housing of the liquid crystal projector apparatus of FIG. 1.

FIG. 6 shows an example of an internal structure of the housing 101. The optical unit 104 described above is disposed in the lower portion 103 of the housing 101. When a cooling fan 140 rotates, the air is circulated in the direction indicated by arrow marks A1, A2, A3 and A4 in the space 141 in the housing 101.

The circulation of the air cools the liquid crystal panels 200, 201 and 202 of the optical unit 104 shown in FIG. 5 such that the internal air in the space 141 is circulated without taking in air from the outside of the housing 101 in order to prevent dust and so forth from being taken into the housing 101 from the outside. The space 141 is formed as a section separate from such a space for cooling the light source 2 as shown in FIG. 3.

Light L projected from the projection lens 32 shown in FIG. 6 is reflected by the mirror 102 as indicated by alternate long and short dash lines and is projected in an enlarged scale on the inner face side of the screen 106. The air in the space 141 is circulated such that it passes the inside of the optical unit 104 and the inside of the screen 106 and inside of the mirror 102 and then passes an air circulation path 147.

Figure 7:
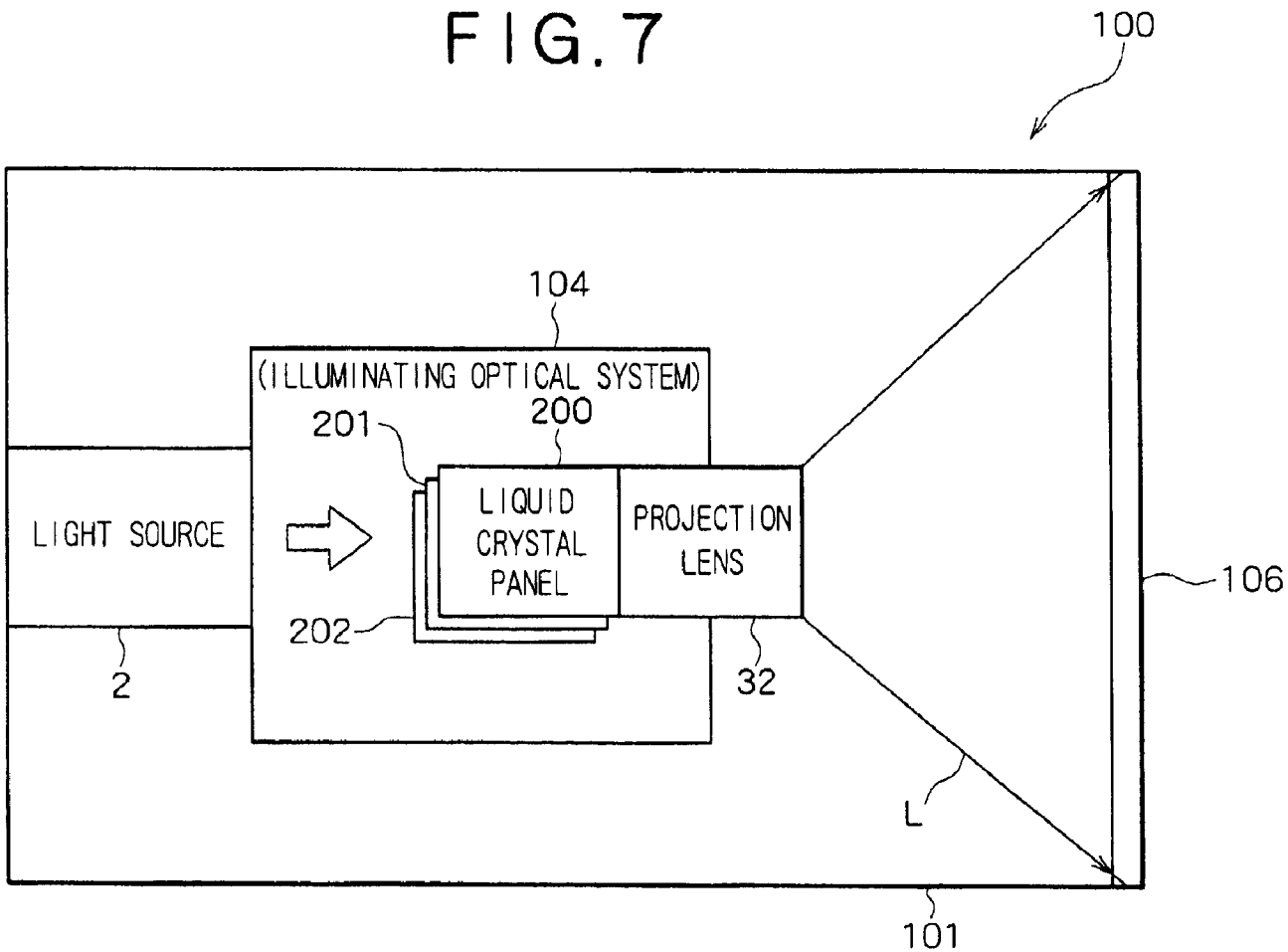
FIG. 7 is a view showing a simplified form of the structure of the liquid crystal projector apparatus.

FIG. 7 is a simplified figure of an example of an internal structure of the liquid crystal projector apparatus 100 of FIG. 1. In FIG. 7, the light source 2, the optical unit 104 which is an illuminating optical system, the three liquid crystal panels 200, 201 and 202, the projection lens 32, the screen 106 and so forth are shown, and the elements mentioned are accommodated in the housing 101.

Figure 8:
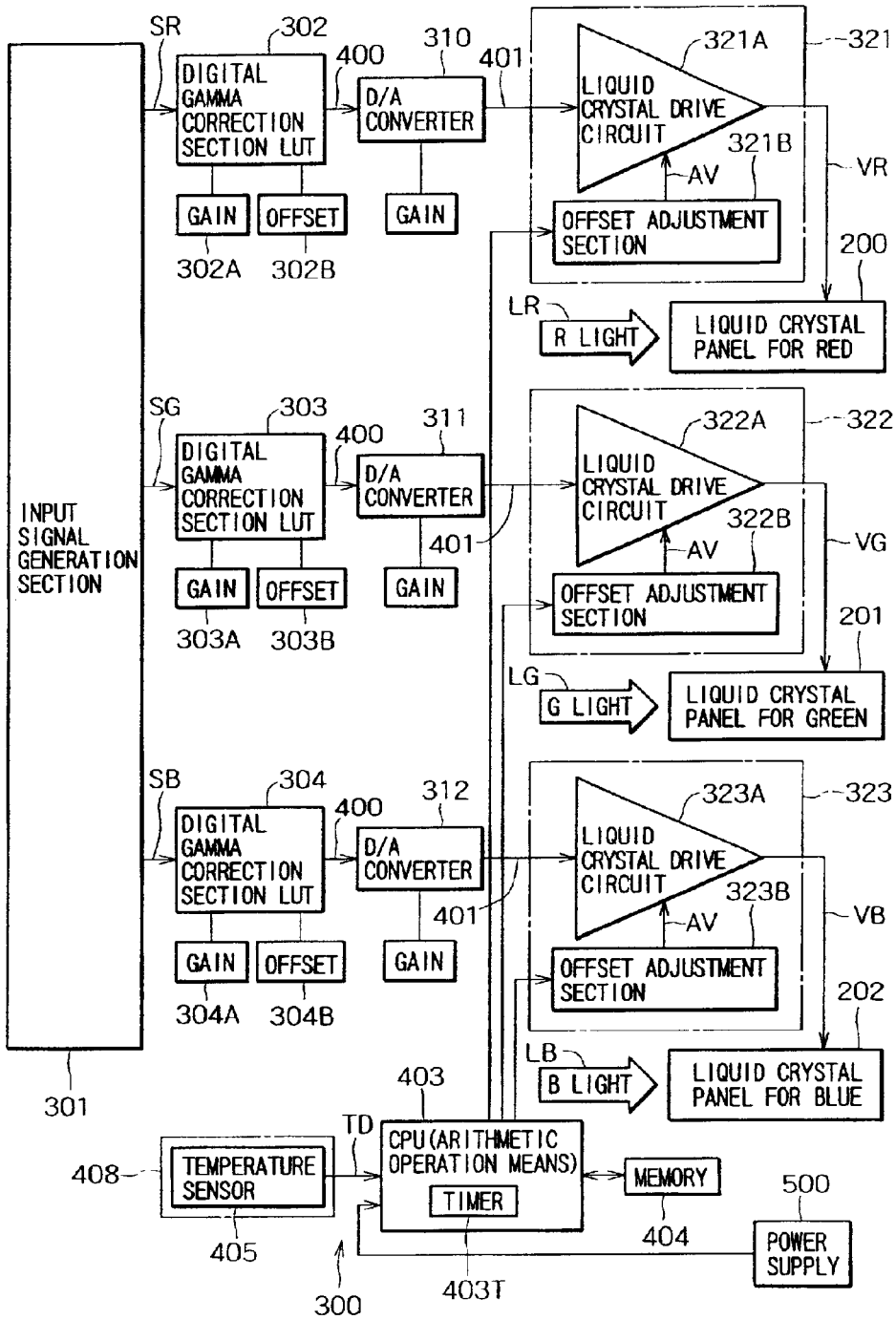
FIG. 8 is a view showing an example of a driving control circuit used for the liquid crystal projector apparatus.

FIG. 8 shows an example of a configuration of a driving control circuit 300 for driving the liquid crystal panels 200, 201 and 202.

The driving control circuit 300 generally includes an input signal generation section 301, three digital gamma correction sections 302, 303 and 304, three D/A converters (digital/analog converters) 310, 311 and 312, a first liquid crystal drive section 321, a second liquid crystal drive section 322, a third liquid crystal drive section 323, a CPU (central processing unit) 403 serving as arithmetic operation means, a memory 404, and a single temperature sensor 405.

From the input signal generation section 301, an input signal SR for red, an input signal SG for green and an input signal SB for blue are outputted. The input signal SR for red is inputted to the digital gamma correction section 302. Similarly, the input signal SG for green is inputted to the digital gamma correction section 303, and the input signal SB for blue is inputted to the digital gamma correction section 304.

A gain adjustment section 302A and an offset adjustment section 302B are connected to the digital gamma correction section 302. Similarly, a gain adjustment section 303A and an offset adjustment section 303B are connected to the digital gamma correction section 303, and a gain adjustment section 304A and an offset adjustment section 304B are connected to the digital gamma correction section 304.

The digital gamma correction sections 302, 303 and 304 are parts for digitally gamma correcting the corresponding input signal SR for red, input signal SG for green and input signal SB for blue, respectively.

Figure 9:
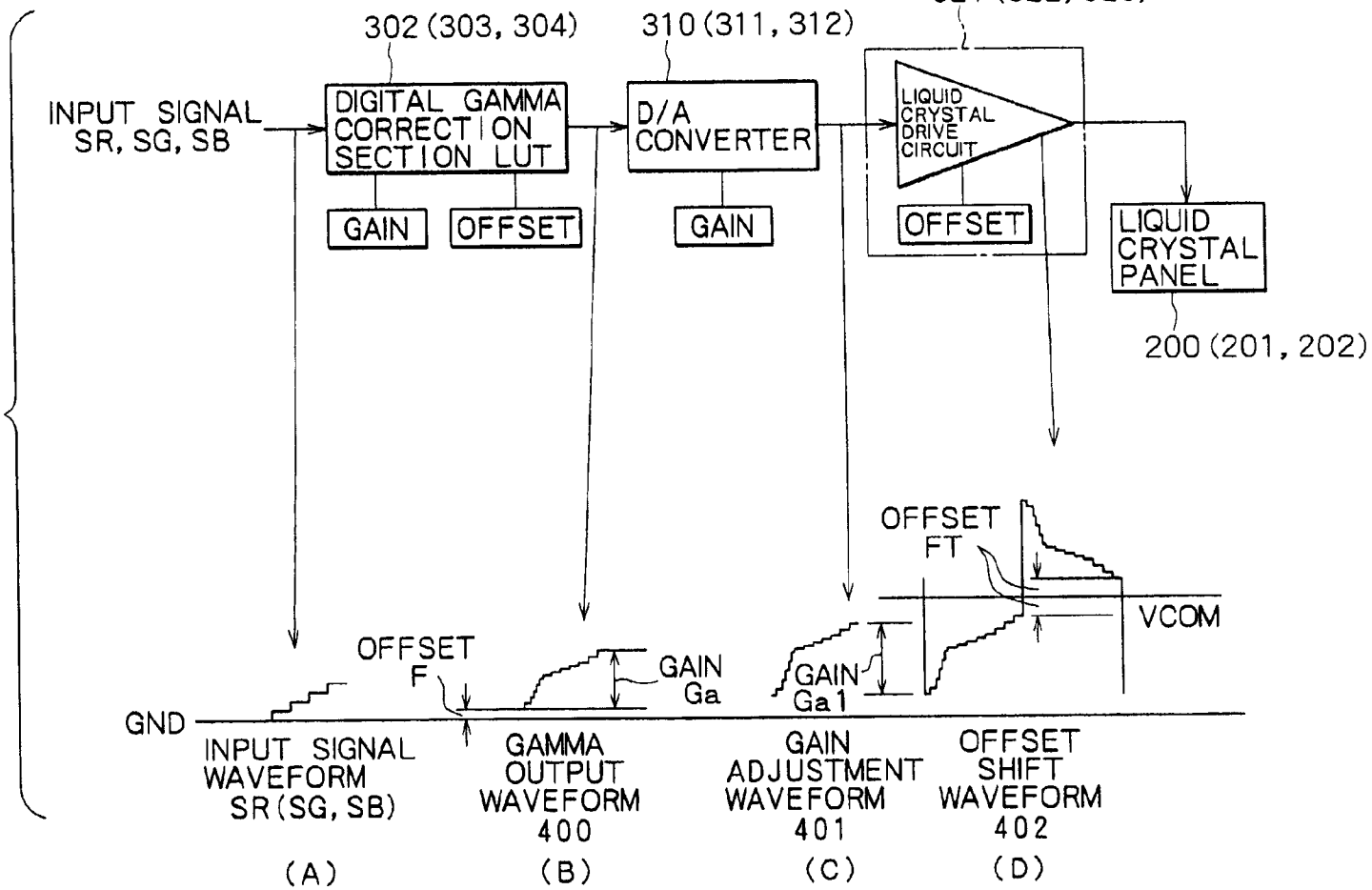
FIG. 9 is a view illustrating an example of a waveform variation at a portion of the circuit of FIG. 8.

The input signals SR, SG and SB have such a stepwise input signal waveform as shown in (A) of FIG. 9. The waveform of the input signals SR, SG and SB is changed into such a gamma output waveform 400 as shown in (B) of FIG. 9 by gamma correction by the digital gamma correction sections 302, 303 and 304. The gamma output waveform 400 has an offset F and a gain Ga set therein by operation of a gain adjustment section and an offset adjustment section. The digital gamma correction sections 302, 303 and 304 gamma correct the input signals SR, SG and SB from the following reason.

FIG. 10 illustrates the meaning of gamma correction simply.

Figures 10A, 10B, 10C:
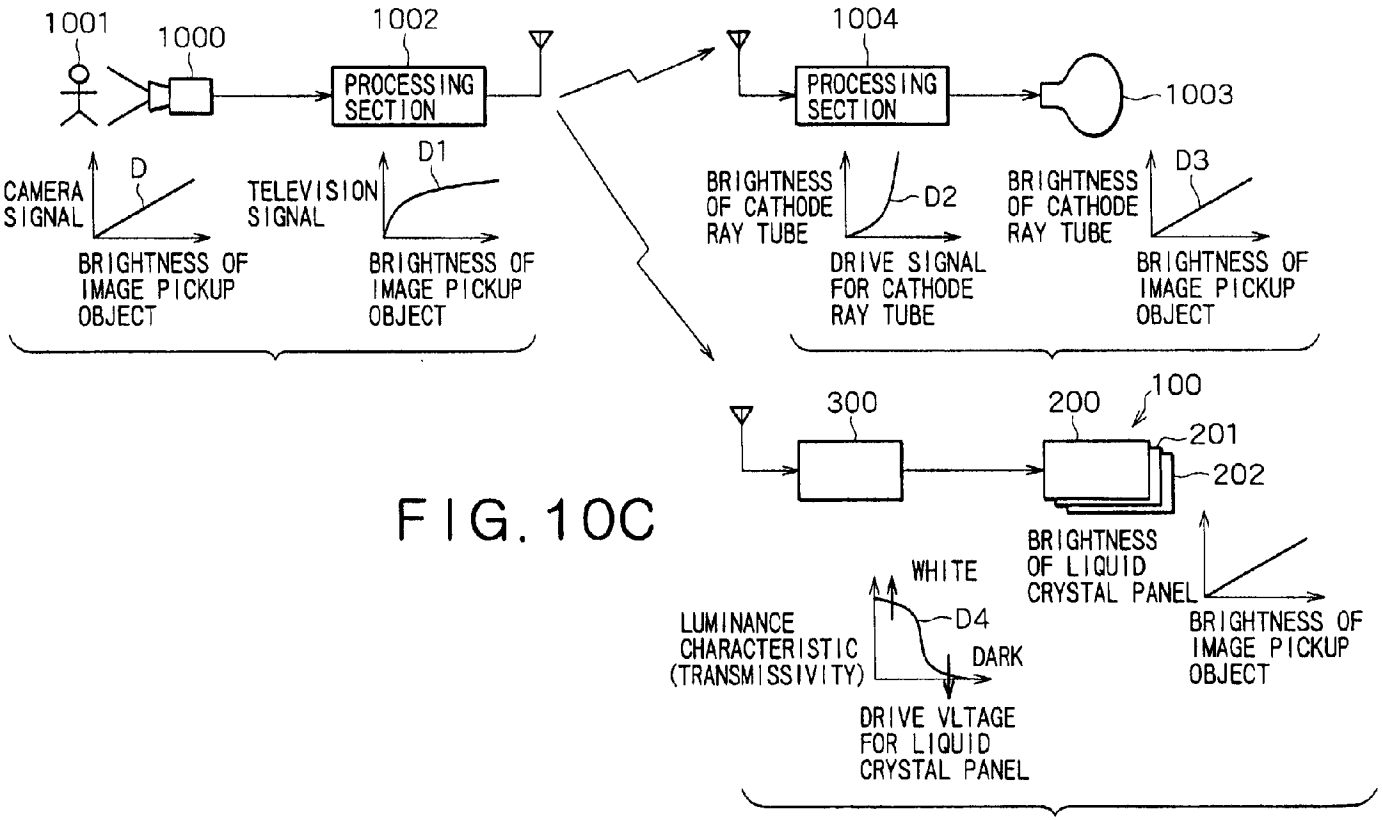
FIGS. 10A to 10C are views illustrating meanings of gamma correction in FIG. 8.

For example, if a camera 1000 on the television station side shown in FIG. 10A picks up an image of an image pickup object 1001, then the relationship between the camera signal and the brightness of the image pickup object can be represented by a straight line D. And, a processing section 1002 transmits the television signal as a broadcasting wave in such a state that it has a characteristic represented by a curve D1 between the brightness of the image pickup object and the television signal.

Meanwhile, a processing section 1004 of a cathode ray tube 1003 side of the user side receives the broadcasting wave as seen in FIG. 10B. The relationship between the brightness of the cathode ray tube 1003 and a drive signal for the cathode ray tube 1003 is such a reverse characteristic as represented by a curve D2 to the curve D1, and as a result, the processing section 1004 can modify the relationship between the brightness of the cathode ray tube 1003 and the brightness of the image pickup object so as to be such as represented by a straight line D3 to play back an image.

However, when it is tried to use the liquid crystal projector apparatus 100 to play back the broadcasting wave from the processing section 1002 side of the broadcasting side as seen in FIG. 10C, the driving control circuit 300 must perform signal conversion different from that of the cathode ray tube 1003 in accordance with a characteristic unique to the liquid crystal panels 200, 201 and 202.

Since the liquid crystal panels 200, 201 and 202 have a peculiar characteristic indicated by a curve D4 called V-T characteristic, if the characteristic is not corrected but an image is displayed with a linear characteristic on the liquid crystal panels 200, 201 and 202, then a resulting image suffers from stopping of white at a portion thereof at which the transmissivity is high while stopping of black occurs at another portion at which the transmissivity is low.

Therefore, it is necessary to use the digital gamma correction sections 302, 303 and 304 shown in FIGS. 8 and 9 to perform correction of the driving voltage-luminance characteristic (transmissivity) (V-T characteristic) for the liquid crystal panels 200, 201 and 202, respectively.

The input signals corrected by the digital gamma correction sections 302, 303 and 304 of FIG. 8 in this manner have a gamma output waveform 400 and are inputted to D/A converters 310, 311 and 312, respectively. A gain adjustment waveform 401 whose gain Gal is adjusted as seen in (C) of FIG. 9 is generated by each of the D/A converters 310, 311 and 312.

The input signals with the gains adjusted after they are gamma corrected in this manner have the gain adjustment waveform 401 and are supplied to the first liquid crystal drive section 321, second liquid crystal drive section 322 and third liquid crystal drive section 323, respectively.

It is to be noted that, since general adjustment of the brightness where the cathode ray tube 1003 is used as shown in FIG. 10 is performed prior to the digital gamma correction sections shown in FIG. 8, non-linear conversion is performed by the digital gamma correction sections. Consequently, by the brightness adjustment (adjustment of the V-T characteristic in the direction of the axis of ordinate), the shift of the curve D4 of the V-T characteristic by the temperature cannot be corrected.

Further, each of the liquid crystal panels uses not driving with a dc voltage but reversed driving as seen from an offset shift waveform 402 shown in (D) of FIG. 9 in order to prevent the image persistence and so forth of the liquid crystal. Therefore, a shift of a curve of the V-T characteristic to a liquid crystal panel corresponds to an offset FT of the offset shift waveform 402 of (D) of FIG. 9. The shift of the offset FT is a shift with respect to a common voltage VCOM. In short, in order to correct the shift of the curve of the V-T characteristic, the values of the driving voltage to be applied to the liquid crystal panels 200, 201 and 202 must be corrected in response to the temperatures of the liquid crystal panels 200, 201 and 202 after correction by the digital gamma correction sections.

Referring back to FIG. 8, the first liquid crystal drive section 321 includes a liquid crystal drive circuit 321A and an offset adjustment section 321B. The offset adjustment section 321B is a part for performing adjustment of an offset, that is, correction, of a drive voltage VR generated by the liquid crystal drive circuit 321A.

Also the second liquid crystal drive section 322 similarly includes a liquid crystal drive circuit 322A and an offset adjustment section 322B. The offset adjustment section 322B is provided to perform adjustment of an offset, that is, correction, of a drive voltage VG generated by the liquid crystal drive circuit 322A.

The third liquid crystal drive section 323 includes a liquid crystal drive circuit 323A and an offset adjustment section 323B. The offset adjustment section 323B is provided to perform adjustment of an offset, that is, correction, of a drive voltage VB generated by the liquid crystal drive circuit 323A.

The temperature sensor 405 shown in FIG. 8 is connected to the CPU 403 serving as arithmetic operation means. Also the memory 404 is connected to the CPU 403. The CPU 403 includes a timer 403T.

The timer 403T is provided to count the time after power supply starting at which a power supply 500 is started till steady operation entering.

The temperature sensor 405 shown in FIG. 8 is characterized in that it is disposed at a location in the housing other than the liquid crystal panels in the liquid crystal projector apparatus. The temperature sensor 405 is disposed, for example, on the circuit board 408 of the optical unit 104 which is a location other than the liquid crystal panels 200, 201 and 202. The circuit board 408 is shown also in FIG. 4.

Since the temperature sensor 405 is not disposed directly on the liquid crystal panels 200, 201 or 202 and it is neither necessary to dispose the temperature sensor on a small liquid crystal panel nor necessary to dispose the temperature sensor at a portion exposed to light, it is easy to mount from the structure.

The temperature sensor 405 detects the temperature in the housing of the liquid crystal projector apparatus on the circuit board 408. Temperature detection data TD detected by the temperature sensor 405 is inputted to the CPU 403. The CPU 403 stores the temperature detection data TD into the memory 404, for example, within a period of time after power supply starting till steady operation entering.

The CPU 403 serving as arithmetic operation means estimates the temperatures of the liquid crystal panels based on the temperature detection data stored in the memory 404 to indirectly obtain actual temperatures of the liquid crystal panels.

Since the temperature sensor 405 is not disposed directly on the liquid crystal panel 200, 201 or 202 but is disposed on the circuit board 408 spaced away from the liquid crystal panels in this manner, the temperature sensor 405 does not directly measure the temperature of the liquid crystal panels.

Accordingly, in order to estimate the temperatures of the liquid crystal panels to indirectly obtain them, the CPU 403 arithmetically operates in accordance with the following expression (1) to obtain the temperatures of the liquid crystal panels.

$$\text{Temperature of liquid crystal panel} = \text{indication temperature of temperature sensor} + \text{starting time shift temperature} \quad (1)$$

Figure 11:
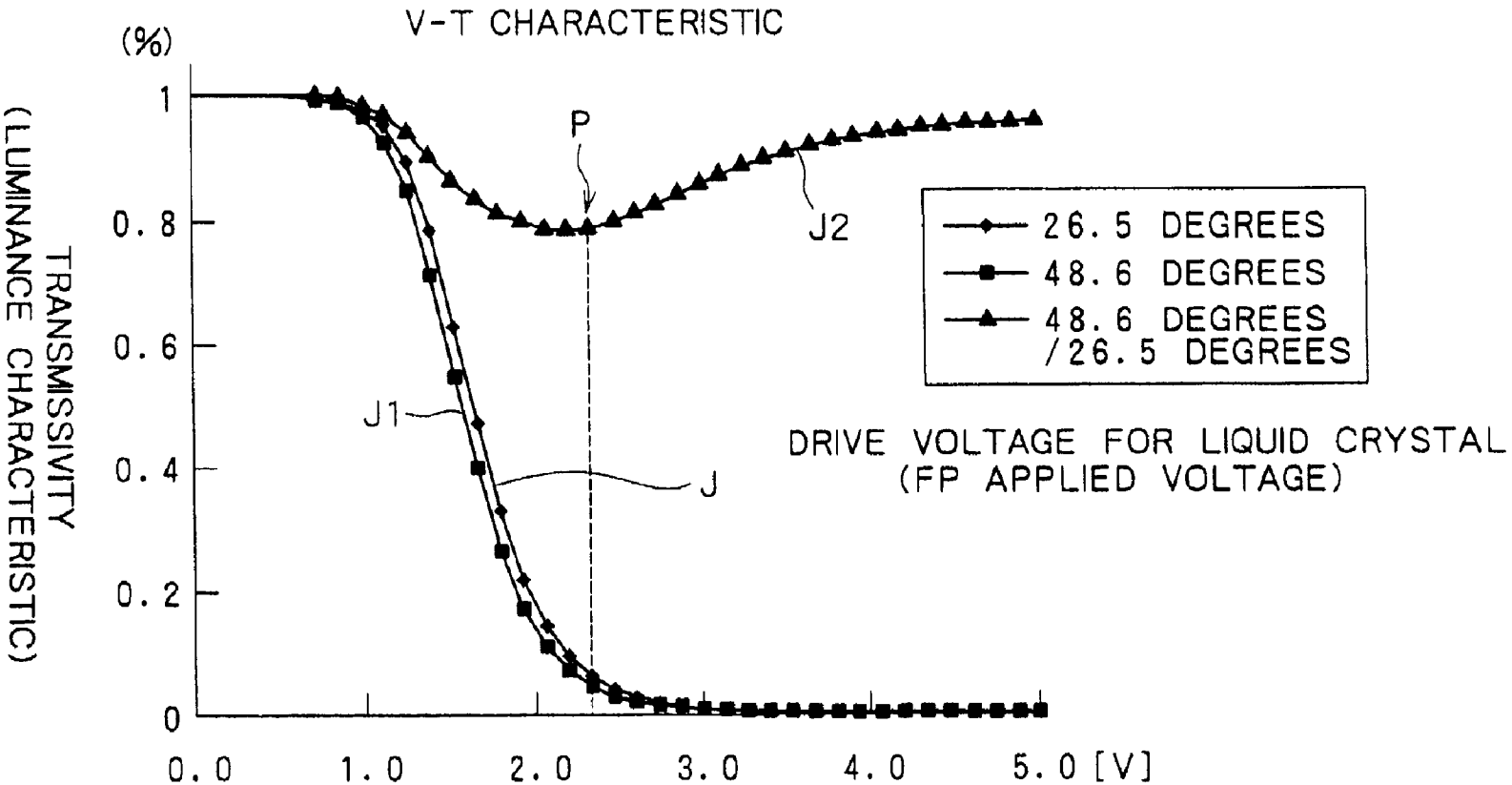
FIG. 11 is a view illustrating an example of a V-T (liquid crystal drive voltage-transmissivity) characteristic of a liquid crystal panel.

FIG. 11 illustrates examples of the V-T characteristic of a liquid crystal panel.

Referring to FIG. 11, the axis of ordinate indicates the transmissivity (called also as luminance characteristic) of the liquid crystal panel, and the axis of abscissa indicates the driving voltage (applied voltage) for the liquid crystal panel.

In the V-T characteristic, a temperature curve J represents a V-T characteristic where the temperature of the liquid crystal panel is 26.5° C. Another temperature curve J1 represents a V-T characteristic where the temperature of the liquid crystal panel is 48.6° C. A further temperature curve J2 represents a ratio between the V-T characteristics where the temperature of the liquid crystal panel is 48.6°/26.5° C.

Usually, in a cathode ray tube or the like, brightness adjustment of an image is performed by varying the amplitude of an input signal of FIG. 9. This is because the system is such that a variation of the applied voltage appears directly as a variation of the brightness from the characteristic of FIG. 10B.

In contrast, in a liquid crystal panel, since it has the V-T characteristic illustrated in FIG. 11, a linear variation of the applied voltage appears as a non-linear variation of the brightness, the adjustment shown in (B) of FIG. 9 is performed to correct the V-T characteristic in FIG. 10. And therefore, the method of the brightness adjustment used in a system of a cathode ray tube and so forth, that is, the method of varying the amplitude of an input signal, cannot be used to cancel the shift of the V-T characteristic by the temperature of FIG. 11. In other words, the shift of the V-T characteristic can be corrected only at the section of (D) of FIG. 9 after the V-T characteristic correction of FIG. 9.

Figure 12:
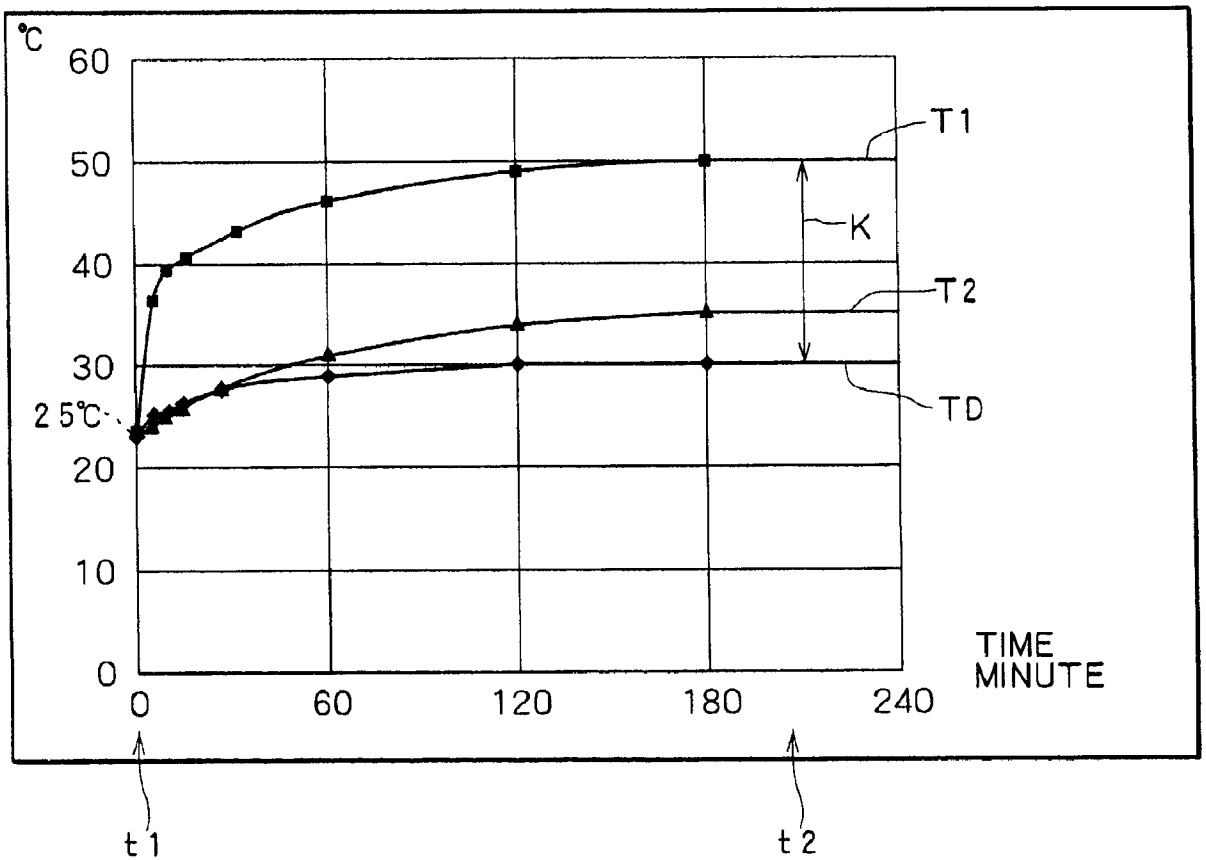
FIG. 12 is a view illustrating an example of a temperature of a liquid crystal panel, a temperature in a housing and temperature detection data by a temperature sensor.

FIG. 12 illustrates variations of the temperature detection data TD detected by the temperature sensor 405 of FIG. 8, the actual temperature T1 of a liquid crystal panel and the temperature T2 in the housing within a time from the power supply starting time t1 at which the power supply is started to the time t2.

At the power supply starting time t1, the temperature detection data TD, the temperature T1 of the liquid crystal panel and the temperature T2 in the housing are, for example, all 25° C. near to a room temperature.

As the time elapses from the power supply starting time t1 to the steady operation entering time t2, the temperature T1 of the liquid crystal panel rises suddenly when compared with the temperature T2 in the housing and the temperature detection data TD. Thereafter, the temperature T1 of the liquid crystal panel rises moderately substantially in parallel to the temperature T2 in the housing and the temperature detection data TD, and the temperature T1 of the liquid crystal panel reaches 50° C. at the steady operation entering time t2. The temperature T2 in the housing is approximately 35° C. at the steady operation entering time t2, and the temperature detection data TD is approximately 30° C.

Figure 13:
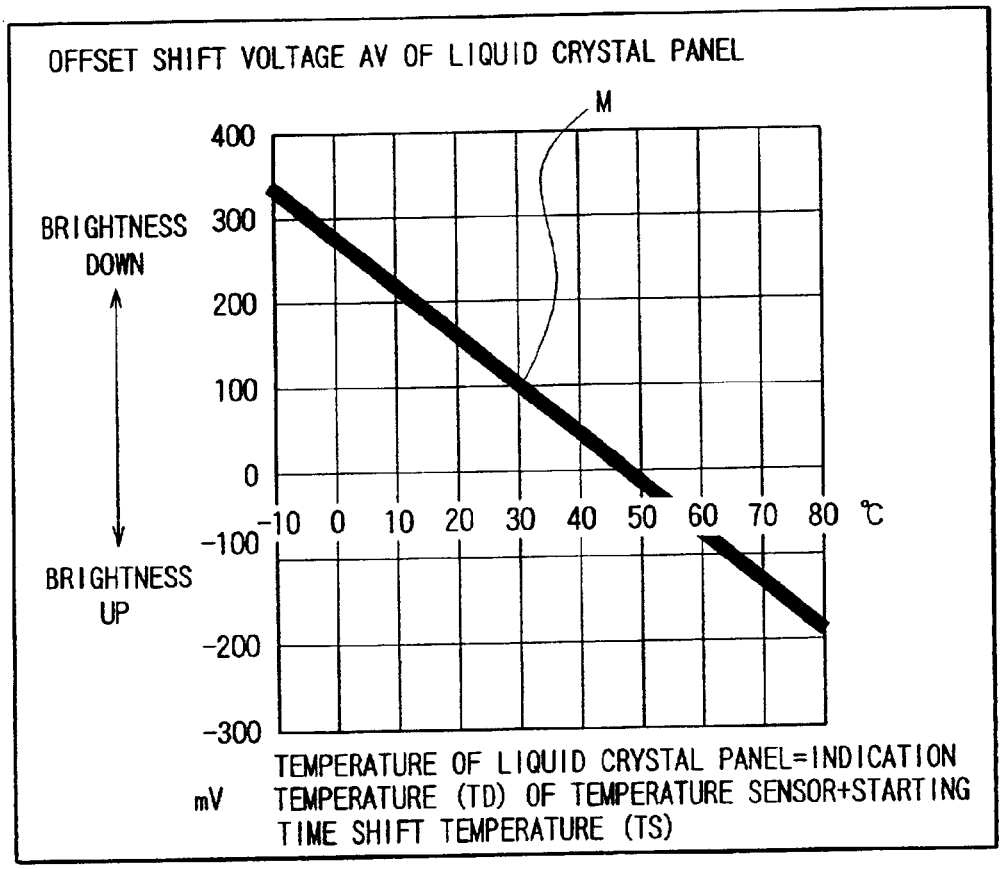
FIG. 13 is a view illustrating a relationship of the temperature of a liquid crystal panel to an offset shift voltage of the liquid crystal panel.

FIG. 13 illustrates an example of an estimation arithmetic operation process of the temperature of a liquid crystal panel given as the expression (1) above.

An offset shift voltage AV of the liquid crystal panel is indicated by the axis of ordinate, and the temperature of the liquid crystal panel to be estimated is indicated by the axis of abscissa.

The offset shift voltage AV of the liquid crystal panel of the axis of ordinate represents data for shifting the driving voltage for the liquid crystal of the axis of abscissa of the V-T characteristic of FIG. 11 along the axis of abscissa. The offset shift voltage AV of the liquid crystal panel is, in the first liquid crystal drive section 321 of FIG. 8, an offset shift voltage AV to be supplied from the offset adjustment section 321B to the liquid crystal drive circuit 321A. This similarly applies to the second liquid crystal drive section 322 and also the third liquid crystal drive section 323. In particular, the offset adjustment section 322B supplies another offset shift voltage AV to the liquid crystal drive circuit 322A. The offset adjustment section 323B supplies a further offset shift voltage AV to the liquid crystal drive circuit 323A.

Referring back to FIG. 13, if the value of the offset shift voltage AV of the axis of ordinate is shifted in the positive direction, then the brightness of the liquid crystal panel decreases, but if the value of the offset shift voltage AV is shifted in the negative direction, then the brightness of the liquid crystal panel increases.

It is indicated by the expression 1 given hereinabove that the temperature of a liquid crystal panel is the sum of the indication temperature (temperature detection data TD) of the temperature sensor and a starting time shift temperature TS.

Figure 14A:
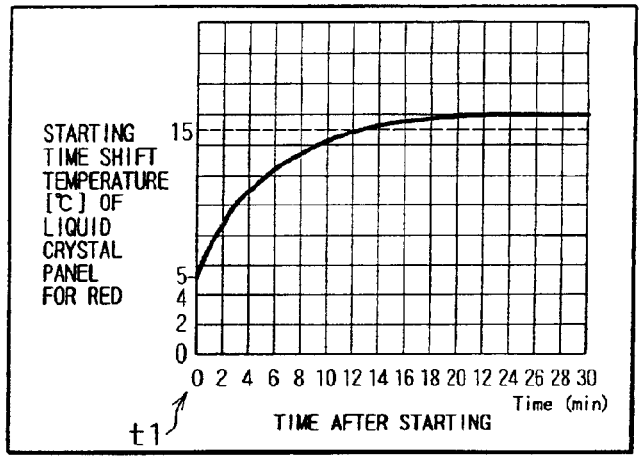
FIGS. 14A to 14C are views illustrating an example of a relationship of the time after power supply starting to the starting time shift temperatures of liquid crystal panels for red, green and blue.
Figure 14B:
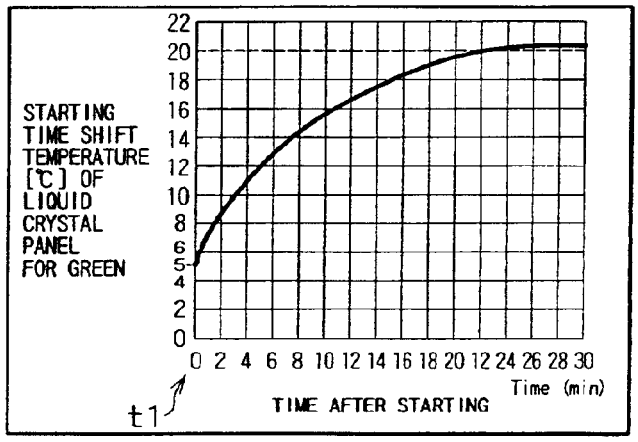
Figure 14C:
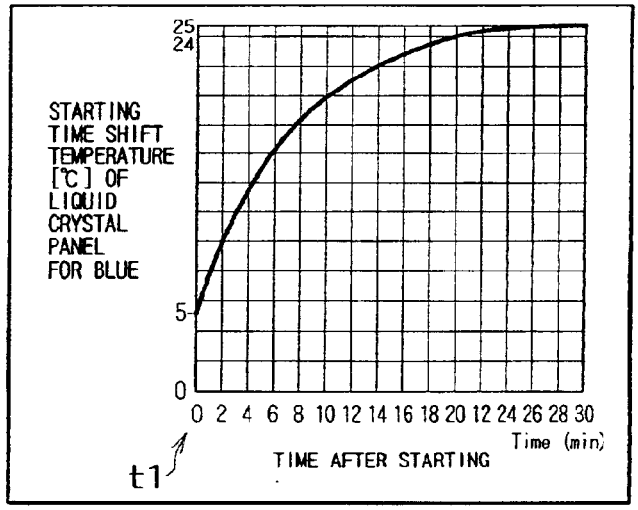

The starting time shift temperature TS can be obtained in a manner illustrated in FIG. 14. FIG. 14A indicates a relationship of the time from the power supply starting time to the starting time shift temperature of the liquid crystal panel for red. FIG. 14B indicates a relationship of the time from the power supply starting time to the starting time shift temperature of the liquid crystal panel for green. FIG. 14C indicates a relationship of the time from the power supply starting time to the starting time shift temperature of the liquid crystal panel for blue.

Data of FIG. 14A, FIG. 14B and FIG. 14C represent data of the starting time shift temperature TS, respectively. The data of the starting time shift temperature TS is obtained, for each of the liquid crystal panels, by plotting the difference K between the temperature T1 and the temperature detection data TD of the liquid crystal panel of the example illustrated in FIG. 12 from the power supply starting time t1 to the steady operation entering time t2.

Whereas the starting time shift temperature of the liquid crystal panel for red is 5° C. at the power supply starting time t1 as seen in FIG. 14A, the starting time shift temperature at the steady operation entering time is 15° C. Whereas the starting time shift temperature of the liquid crystal panel for green is 5° C. at the power supply starting time t1 as seen in FIG. 14B, the starting time shift temperature at the steady operation entering time is 20° C. Whereas the starting time shift temperature of the liquid crystal panel for blue is 5° C. at the power supply starting time t1 as seen in FIG. 14C, the starting time shift temperature at the steady operation entering time is 25° C.

In this manner, the temperature at the steady operation entering time is a little different among the different liquid crystal panels. Based on the starting time shift temperatures TS of the liquid crystal panels for the different colors, the temperatures of the liquid crystal panels are estimated as seen in FIG. 13 using the expression (1).

Now, a driving method for the liquid crystal projector apparatus described above is described with reference to FIG. 16.

First in a temperature detection step ST1, the temperature sensor 405 of FIG. 8 detects the temperature, for example, of the circuit board 408 which is a location other than the liquid crystal panels in the housing 101 of the liquid crystal projector apparatus 100 shown in FIG. 1.

The temperature sensor 405 supplies the temperature detection data TD to the CPU as seen in FIG. 8. The CPU 403 can obtain the temperature detection data TD from the temperature sensor 405 for a period of time after the power supply starting time of the power supply 500 till a steady operation entering time. The above period of time is determined by the timer 403T. The temperature detection data TD obtained in this manner, which supplied from the CPU is stored in the memory 404.

The temperature detection data TD of the temperature sensor 405 corresponds to the indication temperature of the temperature sensor illustrated in FIG. 13. The CPU 403 serving as arithmetic operation means arithmetically operates and estimates the temperatures of the liquid crystal panels as seen in FIG. 13 in an arithmetic operation step ST2 of FIG. 16. In particular, the temperature of each liquid crystal panel is obtained by adding the starting time shift temperature TS to the temperature detection data TD which is the indication temperature of the temperature sensor. However, the starting time shift temperature of the liquid crystal panel for red illustrated in FIG. 14A, the starting time shift temperature of the liquid crystal panel for green illustrated in FIG. 14B and the starting time shift temperature of the liquid crystal panel for blue illustrated in FIG. 14C have different values from one another.

As seen in FIG. 13, the temperature of a liquid crystal panel for which estimation is to be performed is represented by the axis of abscissa, and the offset shift voltage AV of the liquid crystal panel is represented by the axis of ordinate. The relationship between the offset shift voltage AV and the temperature of the liquid crystal panel can be represented linearly by a characteristic line M. The offset shift voltages AV of the liquid crystal panels are adjusted in response to the temperatures of the liquid crystal panels for the different colors.

Figure 16:
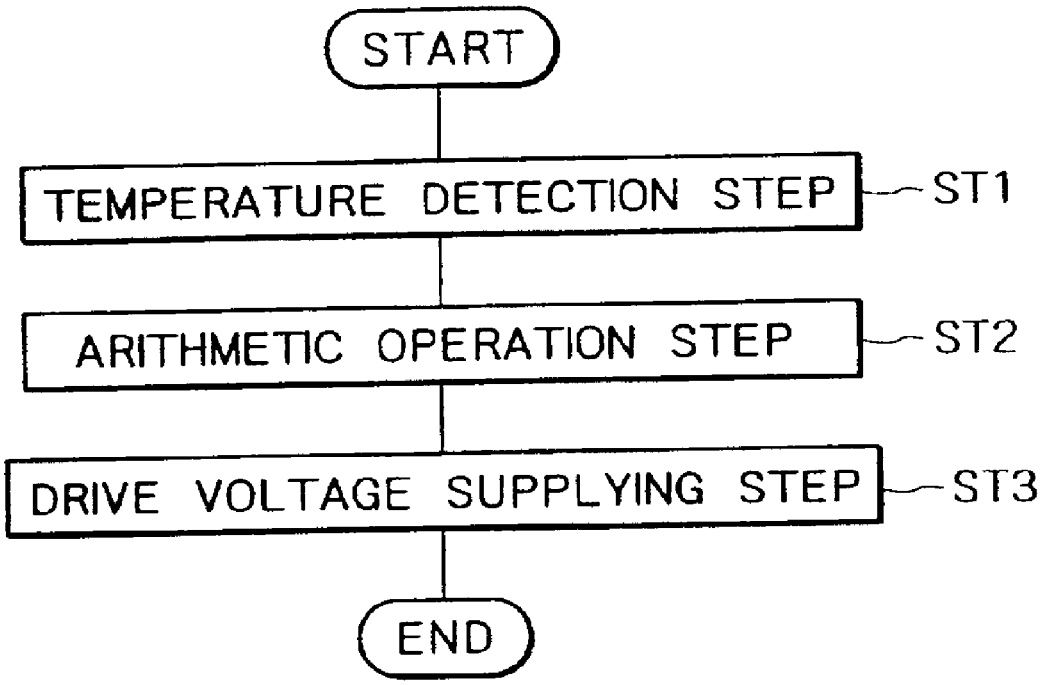
FIG. 16 is a view simply illustrating a driving method for a liquid crystal projector apparatus of the present invention.

Thus, in a drive voltage supplying step ST3 of FIG. 16, a control amount for the offset shift voltage AV illustrated in FIG. 13 for the liquid crystal panel 200 for read is provided to the offset adjustment section 321B of the first liquid crystal drive section 321 of FIG. 8 in accordance with an instruction from the CPU 403.

Similarly, another control amount is provided from the CPU 403 to the offset adjustment section 322B of the second liquid crystal drive section 322. To the offset adjustment section 323B of the third liquid crystal drive section 323, a further control amount is provided from the CPU 403.

Consequently, an offset shift voltage AV is provided from the offset adjustment section 321B to the liquid crystal drive circuit 321A, and another offset shift voltage AV is supplied from the offset adjustment section 322B to the liquid crystal drive circuit 322A while a further offset shift voltage AV is supplied from the offset adjustment section 323B to the liquid crystal drive circuit 323A.

As a result, a drive voltage VR corrected with the offset shift voltage AV is supplied from the liquid crystal drive circuit 321A to the liquid crystal panel 200 for red. To the liquid crystal panel 201 for green, another drive voltage VG corrected with the offset shift voltage AV is supplied from the liquid crystal drive circuit 322A. To the liquid crystal panel 202 for blue, a further drive voltage VB corrected with the offset shift voltage AV is supplied from the liquid crystal drive circuit 323A. The offset shift voltages AV supplied from the offset adjustment section 321B, offset adjustment section 322B and offset adjustment section 323B have different values from one another because the values of the start time shift temperature of the liquid crystal panels 200, 201 and 202 are different from one another as seen from FIG. 14A, FIG. 14B and FIG. 14C.

Figure 15:
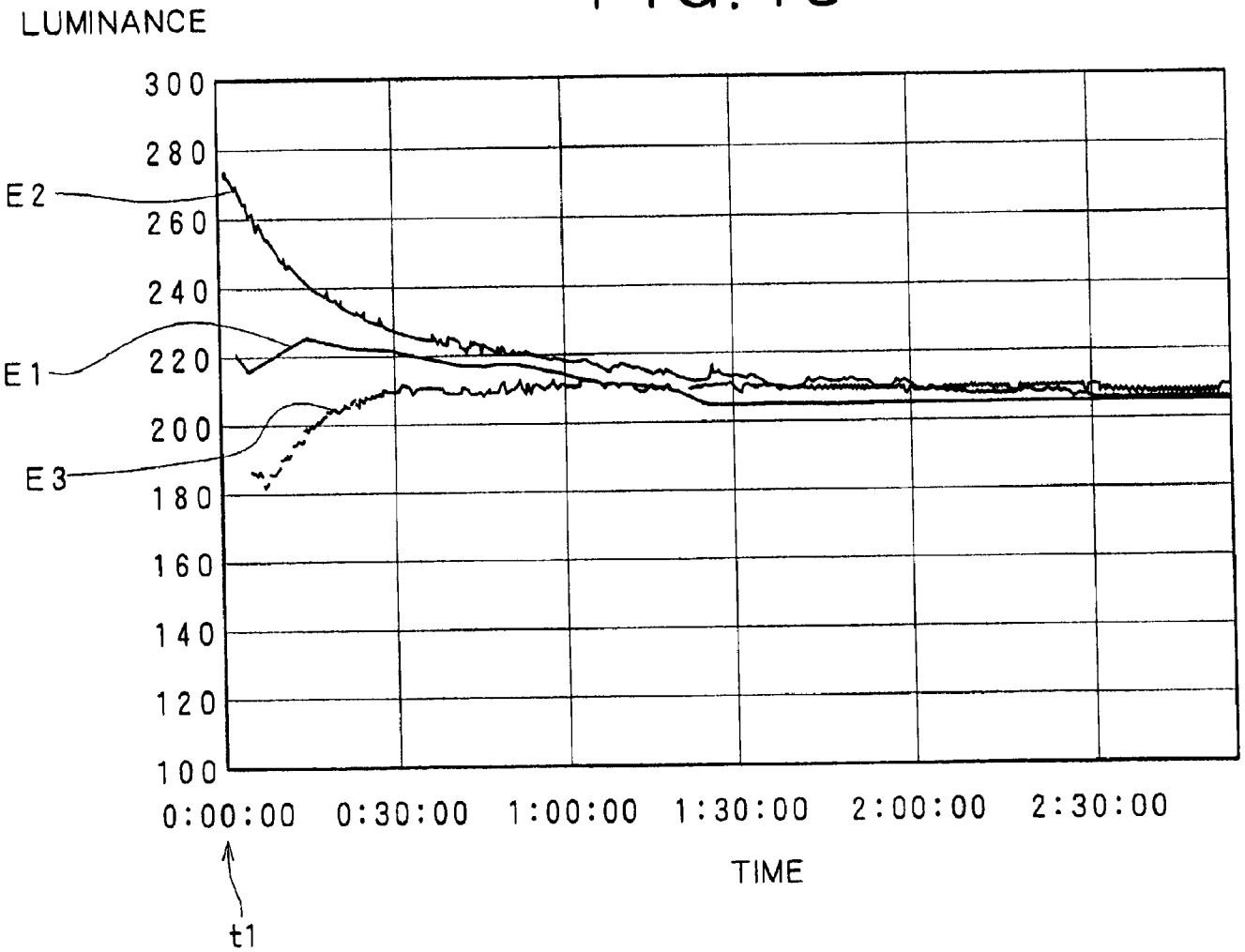
FIG. 15 is a view illustrating an example of a variation of the luminance in a case wherein the drive voltage for a liquid crystal panel is corrected, another case wherein the drive voltage is not corrected and a further case wherein the power supply is re-started.

In FIG. 15, the axis of ordinate indicates the luminance of a liquid crystal panel, and the axis of abscissa indicates the elapsed time from the power supply starting time t1.

A curve E1 indicates an example of a variation of the luminance of the liquid crystal panel when the drive voltage is corrected in the embodiment of the present invention. Another curve E2 indicates a comparative example which is an example wherein correction of the drive voltage for the liquid crystal panel is not performed. Where correction is performed, the luminance exhibits a fixed value substantially stably after the power supply starting time t1 till the steady operation entering time as seen from the curve E1. In contrast, from the curve E2 in the case wherein no correction is performed for the starting voltage, it can be seen that the luminance drops suddenly after the power supply starting time t1.

In a liquid crystal projector apparatus, the stability of the luminance is very significant to the picture quality of a display image because there is no pushup of a peak.

As seen from the curve E2, where no correction is performed, the luminance decreases, for example, by approximately 20%. This is a result of the shifting of the V-T characteristic by a temperature variation.

Although it is possible to perform adjustment with the brightness after 30 minutes by simply shifting the VT characteristic by a luminance drop for a time of, for example, approximately 30 minutes after the power supplying starting time, in this instance, the luminance increases by approximately 20% conversely within the time of 30 minutes. Besides, since the apparatus in question is a liquid crystal projector apparatus, the luminance of the white does not increase any more, and stopping of white occurs within the period of 30 minutes. Further, it is a matter of course that, since the drive voltage for a liquid crystal panel is corrected with an estimated temperature of the liquid crystal panel, also it is possible to cope with a temperature variation by a variation of the environment.

Figure 17:
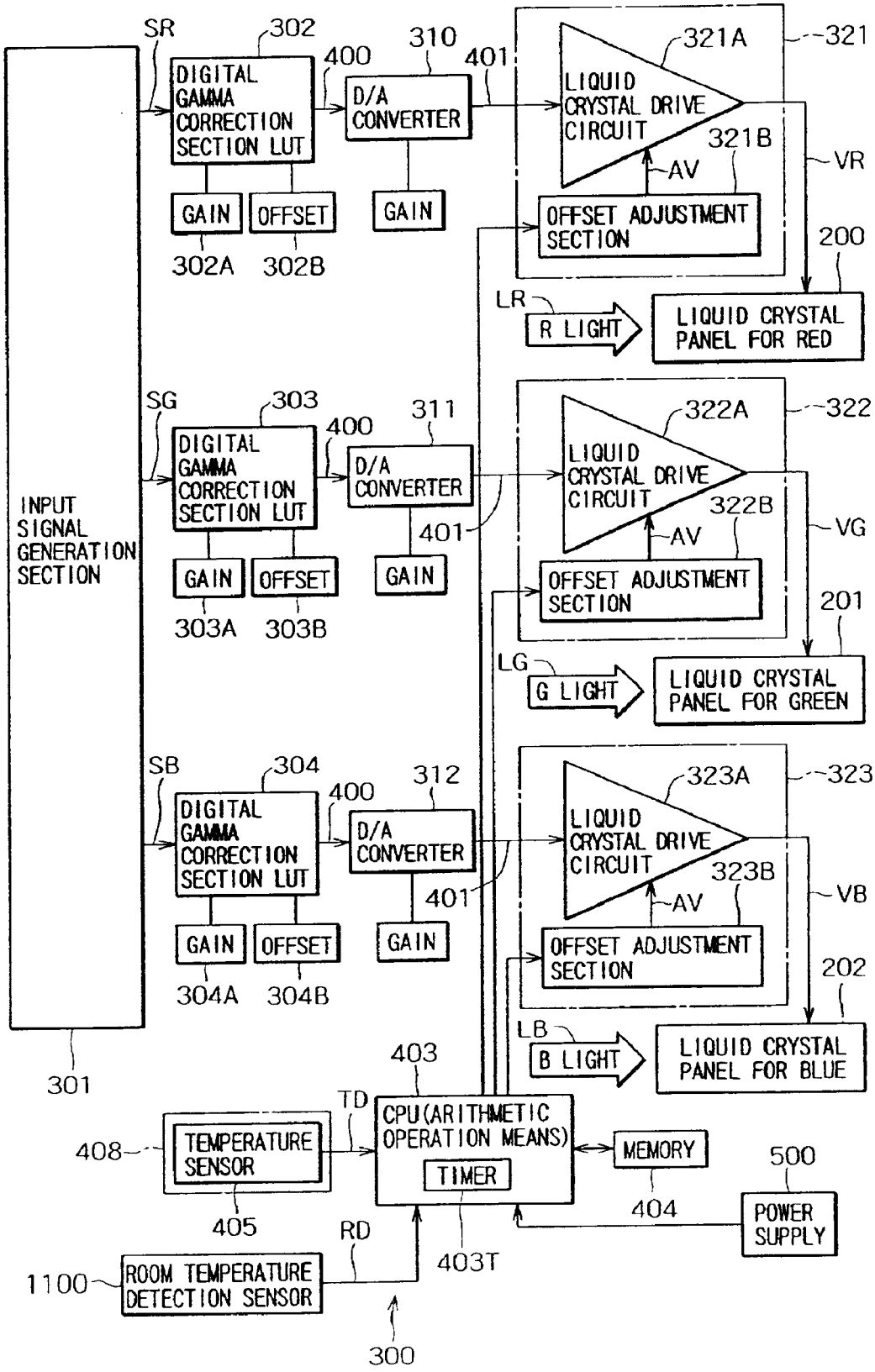
FIG. 17 is a view showing another embodiment of a driving control circuit for a liquid crystal projector apparatus of the present invention.
Figure 18:
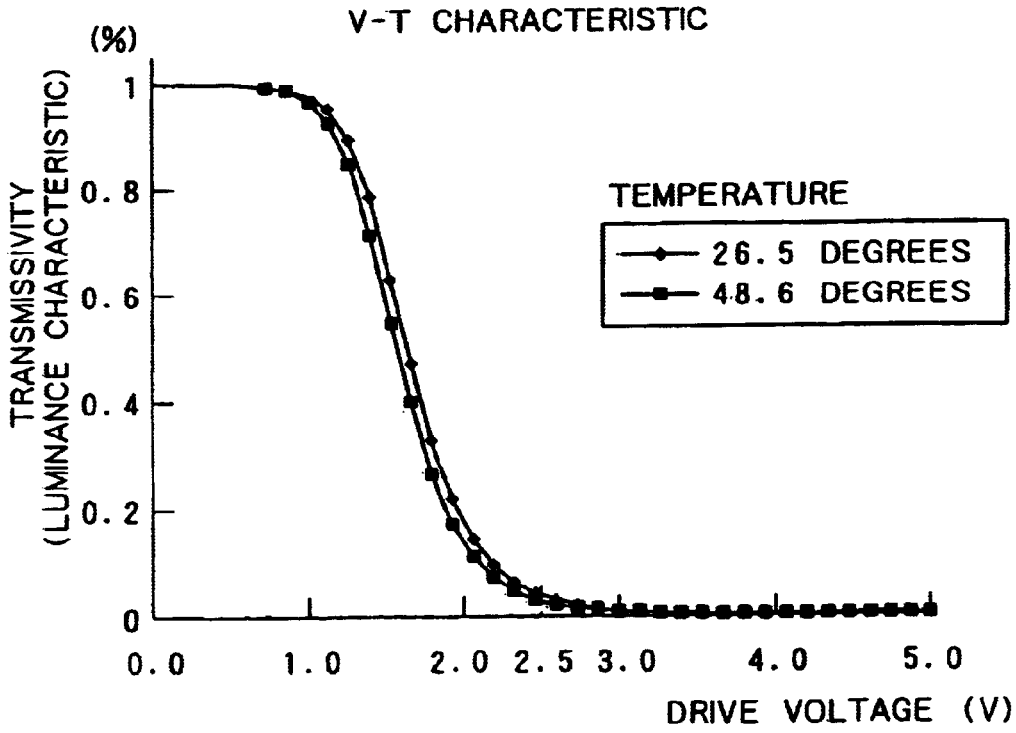
FIG. 18 PRIOR ART
FIG. 18 is a view illustrating an example of a V-T characteristic of a liquid crystal panel.

FIG. 17 shows another embodiment of the present invention.

A driving control circuit 300 of FIG. 17 is substantially similar to the driving control circuit 300 of FIG. 8, but includes, in addition to the temperature sensor 405, an additional room temperature detection sensor 1100.

The additional room temperature detection sensor 1100 is disposed, for example, on an outer face of the housing 101 shown in FIG. 1 and can detect a room temperature of a room in which the liquid crystal projector apparatus 100 is placed.

After the power supply for the liquid crystal projector apparatus is started and the temperature of the liquid crystal panels rises, the power supply may be stopped once and then re-started. When the power supply is re-started in this manner, if correction of the driving voltages for the liquid crystal panels is performed based on the period of time from the starting time, then so-called counter correction takes place. It is to be noted that, in this instance, since the counter correction acts in a direction to lower the luminance, merely a display image becomes darker, and the stopping of white which matters upon the power supply starting does not occur.

In order to prevent such counter correction which makes a display image darker, the room temperature detection sensor 1100 for detecting a room temperature shown in FIG. 17 is provided separately from the temperature sensor 405. A state wherein the power supply for the liquid crystal projector apparatus is started once and then stopped once and thereafter started again, that is, whether re-starting of the power supply is performed, is discriminated based on the difference between room temperature data RD by the room temperature detection sensor 1100 and the temperature detection data TD of the temperature sensor 405 in the housing.

A curve E3 of FIG. 15 indicates an example of a variation of the luminance when re-starting is performed, and it can be seen that, when the power supply is restarted, the luminance drops considerably. Since the CPU 403 arithmetically operates and processes the difference between the temperature detection data TD of the temperature sensor 405 and the room temperature data RD of the room temperature detection sensor to discriminate whether or not re-starting is performed, the CPU 403 can discriminate whether or not the power supply is restarted and can perform such determination that, when the power supply is re-started, it changes the correction values for the drive voltage based on the time after the re-starting time or it does not perform such correction.

It is to be noted that, in the control of the drive voltages to be applied to the liquid crystal panels, dc components of the drive voltages VR, VG and VB to be applied to the liquid crystal panels 200, 201 and 202 shown in FIG. 8 are controlled and corrected.

As described hereinabove, a number of liquid crystal projector apparatus use three liquid crystal panels to form three colors of red, green and blue, and in many cases, the temperatures of the three liquid crystal panels are different from one another as seen from FIG. 14A, FIG. 14B and FIG. 14C from a difference in light energy. In this case, three liquid crystal panels include the correction values based on the difference in the temperature among three colors, respectively, so that it is possible to perform optimum correction for three liquid crystal panels. Where the temperature difference among the three liquid crystal panels is great, the white balance is disordered, and this can be coped with by providing different correction values for them.

Where the starting time shift temperature is used as a separate parameter as in the expression 1 given hereinabove, a panel temperature necessary for temperature correction can be determined from a temperature variation in the housing without directly measuring the temperature of the liquid crystal panel. This is effective where the temperatures of the liquid crystal panels are different from the temperature of the temperature sensor with a liquid crystal projector apparatus wherein internal circulation is used for the liquid crystal panels because the temperature shift by the starting time is great.

In the embodiments of the present invention, the picture quality can be corrected so that picture quality deterioration of white stopping or dark stopping may not occur depending upon a variation of the ambient temperature of the liquid crystal projector apparatus without directly measuring the temperature of the liquid crystal panels of the liquid crystal projector apparatus.

Where an air circulating system in the housing is used as a cooling system for the liquid crystal panels, even with a liquid crystal projector apparatus wherein the temperature variation of the liquid crystal panels cannot be measured directly, such correction as in the case wherein the temperature is measured directly can be performed by correcting the drive voltages depending upon the time after the power supply starting time.

Where not brightness correction by a shift of the V-T characteristic in the direction of the axis of ordinate by a temperature variation of a liquid crystal panel but offset shifting of a liquid crystal drive circuit is used for correction, correction can be performed without varying the gradation property.

Where two temperature sensors are used, also counter correction upon re-starting can be prevented, and optimum correction can be anticipated.

Since a countermeasure against white stopping and dark stopping which occur with a liquid crystal panel from a variation of the ambient temperature can be taken, the dynamic range for utilization of light after the adjustment can be expanded to improve the picture quality.

Where no temperature correction is involved, since an image is represented using the inside of the dynamic range of the liquid crystal panel within which white stopping or dark stopping by a temperature variation does not occur, the luminance and the contrast during use are lowered.

Where correction values for the drive voltage to be applied to the three liquid crystal panels for red, green and blue are provided independently of each other, also a variation in white balance caused by a temperature variation where a temperature difference is present between the liquid crystal panels for different colors can be corrected.

In the liquid crystal projector, temperature data in the apparatus is detected and differences from a temperature variation depending upon time of the liquid crystal panels upon starting are provided as data, and a drive voltage shift depending upon the temperature of the liquid crystal is controlled based on the difference with a calculated value to prevent white stopping and dark stopping.

By the way, the present invention is not limited to the embodiments described above.

In the embodiments described above, a liquid crystal projector apparatus for so-called color display is taken as an example. However, in a liquid crystal projector not for color display but for black-and-white display, not three liquid crystal panels but a single liquid crystal panel may be used. Further, the present invention can be applied also to a liquid crystal projector apparatus wherein a screen is not provided on a housing but an image is projected onto a screen provided at a different position spaced from the housing.

While the preferred embodiments of the present invention have been described using the specific terms, such description is for illustrative purposes only, and it is to be understood that changes and variations may be made without departing from the spirit or scope of the following claims.

What is claimed is:

1. A liquid crystal projector apparatus which includes a plurality of liquid crystal panels for optically modulating light from a light source with an input signal and projects the optically modulated light from said plurality of liquid crystal panels to display an image, said liquid crystal projector apparatus comprising:

a temperature sensor for indirectly detecting a temperature of each of said plurality of liquid crystal panels, a memory for storing temperature detection data obtained by said temperature sensor within a period from a power supply starting time to a steady operation entering time of said liquid crystal projector apparatus, arithmetic operation means for estimating a temperature of each of said plurality of liquid crystal panels by indirectly detecting a temperature of the temperature sensor and adding such temperature to a temperature of a time shift period of the power supply obtained from predetermined graphical relationship of starting time shift data for each of said plurality of liquid crystal panels, and a plurality of liquid crystal drive sections for correcting drive voltages for driving each of said plurality of liquid crystal panels with an output signal of said arithmetic operation means and applying the corrected drive voltages to each of said plurality of liquid crystal panels.

2. The liquid crystal projector apparatus according to claim 1, wherein said plurality of liquid crystal drive sections control a dc component of each of the drive voltages to be applied to each of said plurality of liquid crystal panels to correct the voltages.

3. The liquid crystal projector apparatus according to claim 2, wherein said light source and said plurality of liquid crystal panels are disposed in a housing, and said liquid crystal projector apparatus further comprises cooling means for circulating air in said housing without taking in external air to cool said plurality of liquid crystal panels in said housing.

4. The liquid crystal projector apparatus according to claim 3, wherein said plurality of liquid crystal panels include a liquid crystal panel for red, a liquid crystal panel for green and a liquid crystal panel for blue, and said plurality of liquid crystal drive sections include a first liquid crystal drive section for correcting a drive voltage for driving said liquid crystal panel for red with an output signal of said arithmetic operation means and applying the corrected drive voltage to said liquid crystal panel for red, a second liquid crystal drive section for correcting a drive voltage for driving said liquid crystal panel for green with another output signal of said arithmetic operation means and applying the corrected drive voltage to said liquid crystal panel for green, and a third liquid crystal drive section for correcting a drive voltage for driving said liquid crystal panel for blue with a further output signal of said arithmetic operation means and applying the corrected drive voltage to said liquid crystal panel for blue.

5. The liquid crystal projector apparatus according to claim 1, further comprising a room temperature detection sensor for detecting a room temperature separately from said temperature sensor, and wherein said arithmetic operation means arithmetically operates, at the power supply starting time, a difference between the temperature detection data of said temperature sensor and room temperature detection data of said room temperature detection sensor.

6. A driving method for a liquid crystal projector apparatus which includes a plurality of liquid crystal panels for optically modulating light from a light source with an input signal and projects the optically modulated light from said plurality of liquid crystal panels to display an image, said driving method comprising the steps of:

indirectly detecting a temperature of each of said plurality of liquid crystal panels, storing temperature detection data obtained by said temperature sensor within a period from a power supply starting time to a steady operation entering time of said liquid crystal projector apparatus into a memory, estimating a temperature of each of said plurality of liquid crystal panels by indirectly detecting a temperature of the temperature sensor and adding such temperature to a temperature of a time shift period of the power supply obtained from predetermined graphical relationships of starting time shift data for each of said plurality of liquid crystal panels, and correcting drive voltages for driving each of said plurality of liquid crystal panels based on the estimated temperature and applying the corrected drive voltages to each of said plurality of liquid crystal panels.

7. The driving method for a liquid crystal projector apparatus according to claim 6, wherein said plurality of liquid crystal drive sections control a dc component of the drive voltages to be applied to each of said plurality of liquid crystal panels to correct the voltages.

8. The driving method for a liquid crystal projector apparatus according to claim 7, wherein said light source and said plurality of liquid crystal panels are disposed in a housing, and cooling means circulates air in said housing without taking in external air to cool said plurality of liquid crystal panels in said housing.

9. The driving method for a liquid crystal projector apparatus according to claim 8, wherein said plurality of liquid crystal panels include a liquid crystal panel for red, a liquid crystal panel for green and a liquid crystal panel for blue, and wherein a first liquid crystal drive section corrects a drive voltage for driving said liquid crystal panel for red with an output signal and applies the corrected drive voltage to said liquid crystal panel for red, a second liquid crystal drive section corrects a drive voltage for driving said liquid crystal panel for green with another output signal and applies the corrected drive voltage to said liquid crystal panel for green, and a third liquid crystal drive section corrects a drive voltage for driving said liquid crystal panel for blue with a further output signal and applies the corrected drive voltage to said liquid crystal panel for blue.

10. The driving method for a liquid crystal projector apparatus according to claim 6, wherein said liquid crystal projector apparatus further comprises a room temperature detection sensor for detecting a room temperature separately from said temperature sensor, and calculating a difference between the temperature detection data of said temperature sensor and room temperature detection data of said room temperature detection sensor.

* * * * *